US011480925B2

(12) United States Patent
Tombez

(10) Patent No.: US 11,480,925 B2
(45) Date of Patent: Oct. 25, 2022

(54) MECHANICAL TIMEPIECE COMPRISING A MOVEMENT WHICH RUNNING IS ENHANCED BY A REGULATION DEVICE

(71) Applicant: The Swatch Group Research and Development Ltd, Marin (CH)

(72) Inventor: Lionel Tombez, Bevaix (CH)

(73) Assignee: The Swatch Group Research and Development Ltd, Marin (CH)

( * ) Notice: Subject to any disclaimer, the term of this patent is extended or adjusted under 35 U.S.C. 154(b) by 517 days.

(21) Appl. No.: 16/494,496

(22) PCT Filed: Mar. 16, 2018

(86) PCT No.: PCT/EP2018/056649
§ 371 (c)(1),
(2) Date: Sep. 16, 2019

(87) PCT Pub. No.: WO2018/177774
PCT Pub. Date: Oct. 4, 2018

(65) Prior Publication Data

US 2020/0026240 A1 Jan. 23, 2020

(30) Foreign Application Priority Data

Mar. 28, 2017 (EP) ..... 17163250
May 23, 2017 (EP) ..... 17172491

(51) Int. Cl.
*G04B 17/26* (2006.01)
*G04B 15/14* (2006.01)

(52) U.S. Cl.
CPC ..... *G04B 17/26* (2013.01); *G04B 15/14* (2013.01)

(58) Field of Classification Search
CPC ..... G04B 15/14; G04B 17/26; G04B 18/02; G04B 17/063; G04B 17/00; G04B 17/06;
(Continued)

(56) References Cited

U.S. PATENT DOCUMENTS 4,196,578 A 4/1980 Besson
7,306,364 B2 * 12/2007 Born ..... G04C 11/084 368/204

(Continued)

FOREIGN PATENT DOCUMENTS

CH 711 349 A2 1/2017
CN 1268682 A 10/2000

(Continued)

OTHER PUBLICATIONS

International Search Report dated Jul. 3, 2018 in PCT/EP2018/056649 filed on Mar. 16, 2018.

(Continued)

*Primary Examiner* — Edwin A. Leon
(74) *Attorney, Agent, or Firm* — Oblon, McClelland, Maier & Neustadt, L.L.P.

(57) ABSTRACT

The mechanical timepiece is equipped with a movement which includes an indicator mechanism of at least one time data item, a mechanical resonator forming a slave oscillator which paces the running of the indicator mechanism, and a mechanical correction device to prevent a possible time drift in the running of the indicator mechanism. The mechanical correction device is formed by a master mechanical oscillator and a mechanical braking device of the mechanical resonator, this braking device arranged to apply periodically to the mechanical resonator mechanical braking pulses at a braking frequency determined by the master mechanical oscillator. Then, the mechanical system, formed by the mechanical resonator and the braking device, is configured to enable the braking device to be able to start the braking pulses preferably at any position of the mechanical resonator. Preferably, the braking pulses have a duration of less than one quarter of a set-point period.

23 Claims, 18 Drawing Sheets

(58) Field of Classification Search
CPC ..... G04B 17/20; G04B 17/30; G04B 15/10; G04B 18/04; G04B 18/028; G04B 17/28
See application file for complete search history.

(56) References Cited

U.S. PATENT DOCUMENTS

| | | | | |
|---|---|---|---|---|
| 10,241,473 | B2 * | 3/2019 | Hessler | G04B 17/325 |
| 2007/0091729 | A1 * | 4/2007 | Takahashi | G04B 17/325 368/170 |
| 2010/0214879 | A1 * | 8/2010 | Lechot | G04B 17/063 368/101 |
| 2014/0286140 | A1 * | 9/2014 | Stranczl | G04B 17/063 368/127 |
| 2015/0234352 | A1 | 8/2015 | Hessler et al. | |
| 2017/0045861 | A1 | 2/2017 | Winkler et al. | |

FOREIGN PATENT DOCUMENTS

| | | | |
|---|---|---|---|
| CN | 104849994 | A | 8/2015 |
| CN | 106462109 | A | 2/2017 |
| EP | 1 241 538 | A1 | 9/2002 |
| EP | 2 908 187 | A1 | 8/2015 |
| FR | 833.085 | | 10/1938 |
| JP | 2017-37065 | A | 2/2017 |
| WO | WO 2015/140332 | A2 | 9/2015 |

OTHER PUBLICATIONS

Combined Chinese Office Action and Search Report dated Sep. 2, 2020 in Patent Application No. 201880022339.8 (with English translaiton and English translation of Categories of Cited Documents), 10 pages.
Japanese Office Action dated Sep. 15, 2020 in Patent Application No. 2019-553303 (with English translation), 8 pages.

* cited by examiner

MECHANICAL TIMEPIECE COMPRISING A MOVEMENT WHICH RUNNING IS ENHANCED BY A REGULATION DEVICE

CROSS-REFERENCE TO RELATED APPLICATIONS

This application is a United States national stage application of International Application No. PCT/EP2018/056649, filed Mar. 16, 2018, which designates the United States, and claims priority to European Patent Application No. 17163250.8, filed Mar. 28, 2017, and European Patent Application No. 17172491.7, filed May 23, 2017, and the entire contents of each of the above applications are hereby incorporated herein by reference in entirety.

TECHNICAL FIELD

The present invention relates to a mechanical timepiece comprising a movement wherein the running is enhanced by a device for correcting a potential time drift in the operation of the mechanical oscillator which paces the running of the movement. Such a time drift occurs particularly when the average natural oscillation period of said mechanical oscillator is not equal to a set-point period. This set-point period is determined by an auxiliary oscillator which is incorporated into the correction device.

In particular, the mechanical timepiece is formed, on one hand, by a movement comprising:

- an indicator mechanism of at least one time data item,
- a mechanical resonator suitable for oscillating along a general oscillation axis about a neutral position corresponding to the minimum potential energy state thereof,
- a maintenance device of the mechanical resonator forming therewith a mechanical oscillator which is arranged to pace the running of the indicator mechanism, each oscillation of this mechanical oscillator defining an oscillation period, and, on the other hand, by a device for regulating the medium frequency of the aforementioned mechanical oscillator to enhance the running of the timepiece.

TECHNOLOGICAL BACKGROUND

Timepieces as defined in the field of the invention have been proposed in some prior documents. The patent CH 597 636, published in 1977, proposes such a timepiece with reference to FIG. 3 thereof. The movement is equipped with a resonator formed by a balance-hairspring and a conventional maintenance device comprising a pallet assembly and an escapement wheel kinematically linked with a barrel equipped with a spring. This timepiece movement further comprises an electronic device for regulating the frequency of the mechanical oscillator thereof. This regulation device comprises an electronic circuit and a magnetic assembly formed from a flat coil, arranged on a support arranged under the felloe of the balance, and from two magnets mounted on the balance and arranged close to one another so as to both pass over the coil when the oscillator is activated.

The electronic circuit comprises a time base comprising a quartz generator and serving to generate a reference frequency signal FR, this reference frequency being compared with the frequency FG of the mechanical oscillator. The frequency FG of the oscillator is detected via the electrical signals generated in the coil by the pair of magnets. The regulation circuit is suitable for momentarily inducing a braking torque via a magnetic magnet-coil coupling and a switchable load connected to the coil.

The use of a magnet-coil type electromagnetic system for coupling the balance-hairspring with the electronic regulation device gives rise to various problems. Firstly, the arrangement of permanent magnets on the balance results in a magnetic flux being constantly present in the timepiece movement and in this magnetic flux varying spatially periodically. Such a magnetic flux may have a harmful action on various members or elements of the timepiece movement, particularly on elements made of magnetic material such as parts made of ferromagnetic material. This may have repercussions on the proper operation of the timepiece movement and also increase the wear of pivoted elements. It may indeed be envisaged to screen to a certain degree the magnetic system in question, but screening requires particular elements which are borne by the balance. Such screening tends to increase the size of the mechanical resonator and the weight thereof. Furthermore, it limits the aesthetic configuration possibilities for the balance-hairspring.

Those skilled in the art are also aware of mechanical timepiece movements with which a device for regulating the frequency of the balance-hairspring thereof which is of the electromechanical type is associated. More specifically, the regulation occurs via a mechanical interaction between the balance-hairspring and the regulation device, the latter being arranged to act upon the oscillating balance by a system formed by a stop arranged on the balance and an actuator equipped with a movable finger which is actuated at a braking frequency in the direction of the stop, without however touching the felloe of the balance. Such a timepiece is described in the document FR 2.162.404. According to the concept proposed in this document, it is sought to synchronise the frequency of the mechanical oscillator on that of a quartz oscillator by an interaction between the finger and the stop when the mechanical oscillator exhibits a time drift relative to a set-point frequency, the finger being envisaged to be able to either lock momentarily the balance which is then stopped in the movement thereof during a certain time interval (the stop bearing against the finger moved in the direction thereof upon the return of the balance towards the neutral position thereof), or limit the oscillation amplitude when the finger arrives against the stop while the balance rotates in the direction of one of the end angular positions thereof (defining the amplitude thereof), the finger then stopping the oscillation and the balance starting to move straight away in the opposite direction.

Such a regulation system has numerous drawbacks and it could seriously be doubted that it could form an operational system. The periodic actuation of the finger relative to the oscillation movement of the stop and also a potentially large initial phase shift, for the oscillation of the stop with respect to the periodic movement of the finger towards this stop, pose a number of problems. It should be noted that the interaction between the finger and the stop is limited to a single angular position of the balance, this angular position being defined by the angular position of the actuator relative to the axis of the balance-hairspring and the angular position of the stop on the balance when idle (defining the neutral position thereof). Indeed, the movement of the finger is envisaged to make it possible to stop the balance by a contact with the stop, but the finger is arranged not to come into contact with the felloe of the balance. Furthermore, it should be noted that the time of an interaction between the finger and the stop is also dependent on the amplitude of the oscillation of the balance-hairspring.

It should be noted that the synchronisation sought appears to be unlikely. Indeed, in particular for a balance-hairspring wherein the frequency is greater than the set-point frequency timing the to-and-fro movements of the finger and with a first interaction between the finger and the stop which retains momentarily the balance returning from one of the two end angular positions thereof (correction reducing the error), the second interaction, after numerous oscillations without the stop touching the finger during the alternating movement thereof, will certainly be a stopping of the balance by the finger with immediate inversion of the direction of oscillation thereof, in that the stop abuts against the finger while the balance rotates towards said end angular position (correction increasing the error). Thus, not only is there an uncorrected time drift for a time interval that may be long, for example several hundred oscillation periods, but some interactions between the finger and the stop increase the time drift instead of reducing it! It should further be noted that the phase shift of the oscillation of the stop, and therefore of the balance-hairspring, during the second interaction mentioned above may be significant according to the relative angular position between the finger and the stop (balance in the neutral position thereof).

It may thus be doubted that the desired synchronisation is obtained. Furthermore, in particular if the natural frequency of the balance-hairspring is close but not equal to the set-point frequency, scenarios where the finger is locked in the movement thereof towards the balance by the stop which is situated at this time opposite the finger are foreseeable. Such parasitic interactions may damage the mechanical oscillator and/or the actuator. Furthermore, this limits practically the tangential range of the finger. Finally, the holding duration of the finger in the interaction position with the stop must be relatively short, therefore limiting a correction inducing a delay. In conclusion, the operation of the timepiece proposed in the document FR 2.162.404 appears to be highly unlikely to a person skilled in the art, and such a person is deterred from such a teaching.

SUMMARY OF THE INVENTION

An aim of the present invention is that of finding a solution to the technical problems and drawbacks mentioned above in the technological background.

Within the scope of the present invention, it is sought generally to enhance the precision of the running of a mechanical timepiece movement, i.e. reduce the daily time drift of this mechanical movement. In particular, the present invention seeks to achieve such an aim for a mechanical timepiece movement wherein the running is initially optimally adjusted. Indeed, a general aim of the invention is that of finding a device for preventing a potential time drift of a mechanical movement, namely a device for regulating the running of such a mechanical movement to increase the precision thereof, without for all that renouncing on being able to function autonomously with the best possible precision that this mechanical movement can have by means of the specific features thereof, i.e. in the absence of the regulation device or when the latter is inactive.

Another aim of the present invention is to achieve the aforementioned aims without having to incorporate electrical and/or electronic devices into the timepiece according to the invention, i.e. by using members and systems specific to so-called mechanical watches, which watches can integrate, according to various developments in the mechanical horology field, magnetic elements such as magnets and ferromagnetic elements, but not devices requiring an electrical power supply and thus an electrical power source.

For this purpose, the present invention relates to a timepiece as defined hereinabove in the technical field, wherein the mechanical oscillator mentioned is a slave oscillator and the regulation device is of the mechanical type, this mechanical regulation device being formed by a mechanical auxiliary oscillator, which defines a master oscillator, and by a mechanical braking device of the mechanical resonator of the slave oscillator. The mechanical braking device is arranged to be able to apply to the mechanical resonator of the slave oscillator a mechanical braking torque during periodic braking pulses which are generated at a braking frequency selected solely as a function of a set-point frequency for the slave oscillator and determined by the master oscillator. Then, the mechanical system formed by the mechanical resonator of the slave oscillator and the mechanical braking device is configured so as to enable the mechanical braking device to be able to start the periodic braking pulses at any position of said mechanical resonator in a range of positions, along the general oscillation axis of this mechanical resonator, which extends at least on a first of the two sides from the neutral position of said mechanical resonator over at least one first range of amplitudes that the slave oscillator is liable to have on this first side for a usable operating range of this slave oscillator.

In a general alternative embodiment, the mechanical system mentioned is configured such that said range of positions of the mechanical resonator of the slave oscillator, wherein the periodic braking pulses may start, also extends on the second of the two sides from the neutral position of said mechanical resonator over at least one second range of amplitudes that the slave oscillator is liable to have on this second side, along the general oscillation axis, for the usable operating range of this mechanical oscillator.

In a preferred alternative embodiment, each of the two parts of the range of positions of the mechanical resonator identified hereinabove, incorporating respectively the first and second ranges of the amplitudes that the slave oscillator is liable to have respectively on the two sides from the neutral position of the mechanical resonator thereof, exhibits a certain range whereon it is continuous or quasi-continuous.

In a general alternative embodiment, the mechanical braking device is arranged such that the periodic braking pulses each have essentially a duration of less than one quarter of the set-point period corresponding to the reciprocal of the set-point frequency. In a particular alternative embodiment, the periodic braking pulses have a duration of less than 1/10 of the set-point period. In a preferred alternative embodiment, the duration of the periodic braking pulses is essentially envisaged to be less than 1/40 of the set-point period.

By means of the features of the invention, surprisingly, the slave mechanical oscillator is synchronised on the master mechanical oscillator effectively and rapidly, as will become apparent hereinafter from the detailed description of the invention. The mechanical regulation device forms a device for synchronising the slave mechanical oscillator on the master mechanical oscillator, without closed-loop servo-control and without a measurement sensor of the movement of the mechanical oscillator. The mechanical regulation device therefore functions with an open loop and makes it possible to correct both an advance and a delay in the natural running of the mechanical movement, as will be explained hereinafter. This result is absolutely remarkable. The term 'synchronisation on a master oscillator' denotes herein a servo-control (open-loop, therefore with no feedback) of the slave mechanical oscillator to the master mechanical oscillator. The operation of the regulation device is such that the braking frequency derived from the reference frequency of the master oscillator is forced on the slave oscillator, which paces the running of the time data item indicator mechanism. This does not consist of the scenario of coupled mechanical oscillators, or even of the standard case of a forced oscillator. In the present invention, the braking frequency of the mechanical braking pulses determines the medium frequency of the slave oscillator.

The term 'time the running of a mechanism' denotes setting the pace of the movement of the moving parts of this mechanism when operating, in particular determining the rotational speeds of the wheels thereof and thus of at least one indicator of a time data item.

In a preferred embodiment, the mechanical system formed by the mechanical resonator and the mechanical braking device is configured so as to enable the mechanical braking device to start, in the usable operating range of the slave mechanical oscillator, a mechanical braking pulse substantially at any time of the natural oscillation period of this slave mechanical oscillator. In other words, one of the periodic braking pulses may start substantially at any position of the mechanical resonator of the slave mechanical oscillator along the general oscillation axis of this mechanical resonator.

As a general rule, the braking pulses have a dissipative nature as a portion of the energy of the oscillator is dissipated by these braking pulses. In a main embodiment, the mechanical braking torque is applied substantially by friction, in particular by means of a mechanical braking member applying a certain pressure on a braking surface of the mechanical resonator, which exhibits a certain range (not isolated) along the oscillation axis.

In a particular embodiment, the braking pulses apply a braking torque on the slave resonator, the value whereof is envisaged so as not to momentarily lock this slave resonator during the periodic braking pulses. In this case, preferably, the abovementioned mechanical system is arranged to enable the mechanical braking torque generated by each of the braking pulses to be applied to the slave resonator during a continuous or quasi-continuous time interval (not zero or isolated, but having a certain significant duration).

BRIEF DESCRIPTION OF THE FIGURES

The invention will be described in more detail hereinafter using the appended drawings, given by way of examples that are in no way limiting, wherein.

DETAILED DESCRIPTION OF THE INVENTION

Figure 1:
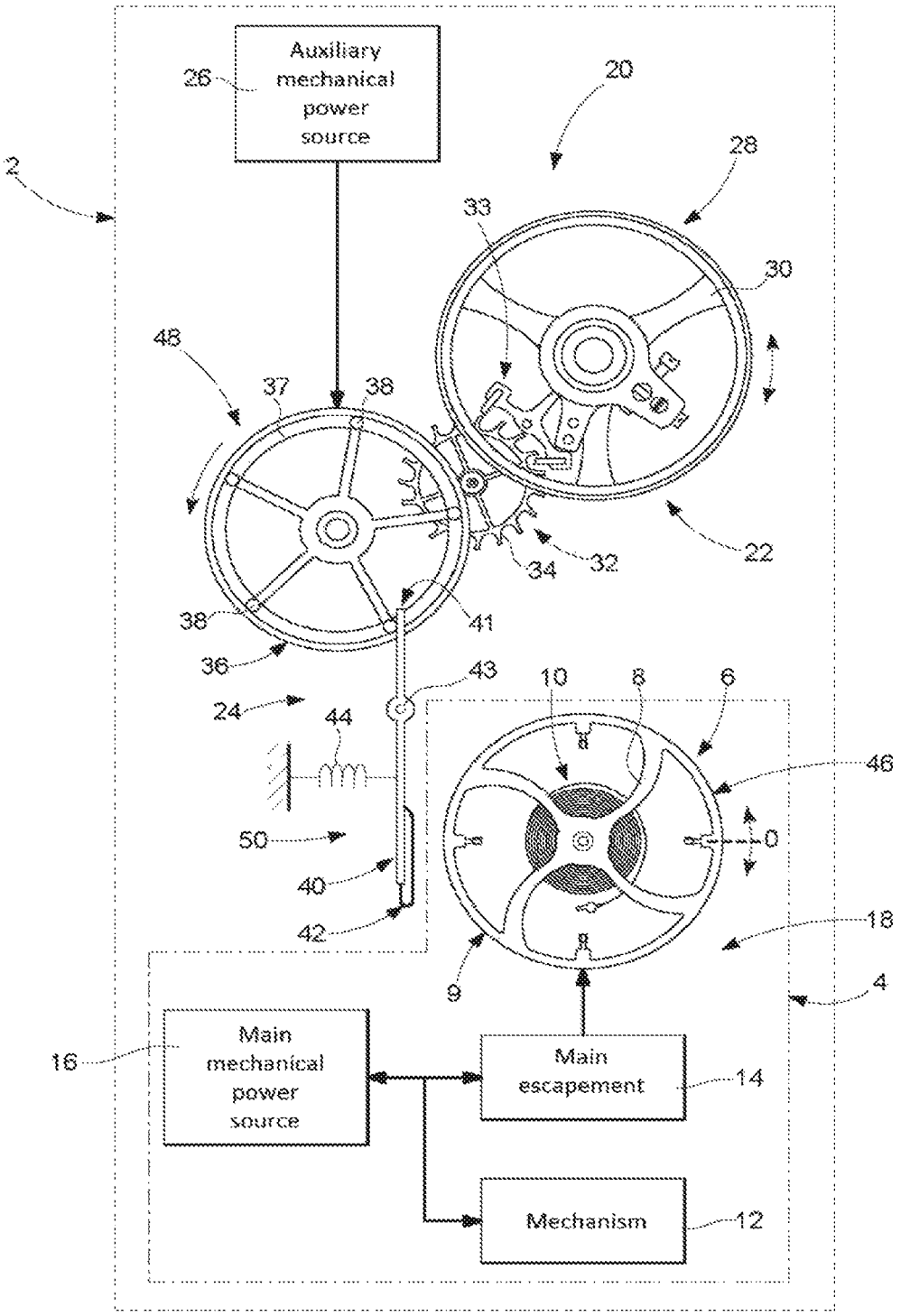
FIG. 1 shows, partially schematically, a first embodiment of a timepiece according to the invention, FIGS. 2A to 2D partially show a second embodiment of a timepiece according to the invention and a sequence of the operation thereof, FIG. 3 partially shows a third embodiment of a timepiece according to the invention.

FIG. 1 shows, in part schematically, a first embodiment of a mechanical timepiece 2 according to the present invention.

It comprises a mechanical timepiece movement 4 which includes an indicator mechanism 12 indicating a time data item. The mechanical movement further comprises a mechanical resonator 6, formed by a balance 8 and a hairspring 10, and a main device for maintaining this mechanical resonator which is formed by a main escapement. This main escapement 14 and the mechanical resonator 6 form a mechanical oscillator 18 which paces the running of the indicator mechanism. The main escapement 14 is formed, for example, by a pallet assembly and an escapement wheel which is kinematically connected to a main mechanical power source 16. The mechanical resonator is suitable for oscillating, about a neutral position (idle position/zero angular position) corresponding to the minimum potential energy state thereof, along a circular axis the radius whereof corresponds for example to the external radius of the felloe 9 of the balance. As the position of the balance is given by the angular position thereof, it is understood that the radius of the circular axis is not important in this case. It defines a general oscillation axis which indicates the nature of the movement of the mechanical resonator, which may be for example linear in another particular embodiment.

The timepiece 2 further comprises a mechanical correction device 20 for correcting a possible time drift in the operation of the mechanical oscillator 18, this mechanical correction device comprising, for this purpose, a mechanical braking device 24 and a master mechanical oscillator 22 (hereafter also referred to as the 'master oscillator'). The master oscillator is associated/coupled with the mechanical braking device in order to provide it with a reference frequency that sets the pace of the operation thereof and determines the braking frequency of the mechanical braking pulses provided by the mechanical braking device. It should be noted that the master oscillator 22 is an auxiliary mechanical oscillator insofar as the main mechanical oscillator, which paces the running of the timepiece movement directly, is the mechanical oscillator 18, the latter thus being a slave oscillator. Generally, the auxiliary mechanical oscillator is by nature or by design more precise than the main mechanical oscillator. In an advantageous alternative embodiment, the master oscillator 22 is associated with a mechanism for equalising the force applied thereon in order to maintain the oscillation thereof.

The master oscillator 22 comprises an auxiliary mechanical resonator 28, in this case conventionally formed by a balance 30 and a hairspring, and an auxiliary maintenance device formed by an auxiliary escapement 32, which comprises, for example, a pallet assembly 33 and an escapement wheel 34 which rotates in steps, one step being carried out at each alternation of the master oscillator. Thus, the average rotational speed of the wheel 34 is determined by the reference frequency of the master oscillator 22. The braking device 24 comprises a control mechanism 48 and a braking pulse generator mechanism 50 (also referred to as a 'pulse generator' hereafter) arranged such that it generates mechanical braking pulses at a braking frequency determined by the control mechanism. This control mechanism comprises a control wheel 37, which is rigidly connected to a wheel set 36 or forming same. The braking pulse generator mechanism comprises a braking member, formed by a pivoting member 40 and a spring 44 associated with the pivoting member.

The wheel set 36 is kinematically connected to an auxiliary mechanical power source 26. This wheel set 36 is a wheel set for transmitting mechanical power from the auxiliary source 26, firstly to the master oscillator 22 and secondly to the braking pulse generator 50. This is an advantageous alternative embodiment insofar as the mechanical correction device requires a single mechanical power source. Since the escapement 32 maintains the resonator 28 via the wheel set 36 which meshes with a pinion of the escapement wheel 34, the latter communicates a pace to the wheel set 36 and thus determines the average angular velocity (since it advances in steps), which is a function of the reference frequency of the master oscillator.

The pivoting member 40 is mounted on a rotational axis 43 and thus forms a two-armed lever. The first end 41 of the lever engages with the control wheel 37, which bears pins 38 arranged such that they successively come into contact with said first end in order to actuate the lever so as to firstly arm the pulse generator by laterally pressing against this first end to then make the lever pivot by compressing the spring 44. The pulse generator is thus armed as the control wheel advances in steps until a step at which a braking pulse is triggered when the pin in contact with the first end passes beyond this first end, which is thus released. The braking device will be adjusted such that this release occurs at once at a determined step of the control wheel. The lever 40 in this case forms a sort of hammer. In order to apply mechanical braking pulses to the balance 8, the lever 40 has, at the second end thereof, a relatively rigid strip spring 42 which forms a braking pad. Following the step at which a braking pulse is triggered, the lever is driven in rotation, thanks to the pressure applied by the spring 44 thus compressed, towards the felloe 9 of the balance and the strip spring undergoes a substantially radial movement relative to the rotational axis of the balance when approaching the felloe. The pulse generator is configured such that the braking pad comes into contact with the lateral surface 46 of the felloe 9 during the first oscillation of the lever subsequent to the release thereof and such that it thus applies a certain force couple on the balance in order to momentarily brake the latter. The braking pulse generator is preferably configured such that the movement of the lever is sufficiently damped to prevent rebounds that would create a series of braking pulses instead of a single braking pulse at the braking frequency. However, this damping is adjusted such that the braking pad comes into contact with the balance during the first oscillation of the lever after the triggering thereof.

The braking pulse generator is arranged such that the periodic braking pulses can have a certain duration, mainly by dynamic dry friction. In this respect, the rigidity and the mass of the strip spring 42 can be selected in a suitable manner. The strip spring 42 allows the shock during the impact thereof on the balance to be damped while extending the duration of contact and while inducing braking by friction between this strip spring and the braking surface envisaged on the balance. Adequate rigidity will also be chosen for the spring 44 and the position of the lever relative to the braking surface will be determined when this spring is idle (in the 'non deformed' position). Finally, it should be noted that other parameters of the pulse generator will be advantageously adjusted, in particular the length of each of the two arms thereof and the position of the anchoring of the spring on one of the two arms thereof.

In an advantageous alternative embodiment, the balance of the master resonator is mounted on flexible strips. Similarly, the pallet assembly of the escapement can be formed by flexible strips defining a bistable system and can include no pivoted shaft. In another specific alternative embodiment, the coupling between the pallet assembly and the escapement wheel is magnetic. In such a case, a magnetic escapement with a stop pin is obtained. Any high-precision mechanical oscillator can thus be incorporated into a timepiece according to the invention. For the purposes of illustration, the master oscillator 22 oscillates at a natural frequency of 10 Hz and has an intrinsic precision that is greater than the slave oscillator 18, the set-point frequency whereof is equal to 3 Hz. The escapement wheel 34 includes twenty teeth and thus performs half a revolution per second (½ rps). In the alternative embodiment shown, the control wheel bears five pins 38 evenly spaced apart on the felloe thereof. Since the reduction ratio between the pinion of the escapement wheel and the control wheel is in this case envisaged to be 7.5 (6-tooth pinion and 45-tooth wheel), the control wheel 37 performs 1/15 revolutions per second (1/15 rps) and the pulse generator is thus armed and released every third of a second, thus generating braking pulses at a frequency of ⅓ Hz (referred to as the 'braking frequency'). Since the set-point frequency for the main oscillator 18 is 3 Hz, the mechanical correction device 20 induces a mechanical braking pulse every nine set-point periods, which substantially corresponds to one pulse every nine oscillation periods of the main oscillator, the natural frequency whereof is adjusted as well as possible on the set-point frequency. The synchronisation obtained by the mechanical correction device according to the invention will be described in detail hereafter.

In an alternative embodiment, the control wheel is envisaged such that it only bears a single pin so as to induce a single braking pulse per revolution. In such a case, the braking frequency is equal to 1/15 Hz and one braking pulse occurs every forty-five set-point periods. In another alternative embodiment which is also functional, as will be shown by the description of the synchronisation phenomenon obtained by the invention, the control wheel has two diametrically opposed pins. In such a case, the braking frequency is equal to 2/15 Hz and one braking pulse occurs every twenty-two and a half periods, i.e. only every forty-five alternations (uneven number) of the slave main oscillator 18.

As a general rule, the mechanical braking device 24 is arranged to be able to apply periodically to the mechanical resonator 6 braking pulses at a braking frequency selected only according to the set-point frequency for the slave main oscillator and determined by the master auxiliary oscillator 22. The mechanical braking device comprises a braking member capable of momentarily coming into contact with a braking surface of the slave mechanical resonator 6. For this purpose, the braking member is movable and has a to-and-fro movement that is controlled by a mechanical control device which periodically actuates same at a braking frequency, such that the braking member periodically comes into contact with the braking surface of the slave mechanical resonator in order to apply braking pulses thereto.

Then, the mechanical system, formed by the slave mechanical resonator 6 and the mechanical braking device 24, is configured so as to enable the mechanical braking device to be able to start the periodic braking pulses at any position of the slave mechanical resonator at least in a certain continuous or quasi-continuous range of positions whereby this slave mechanical resonator is suitable for passing along the general oscillation axis thereof. The alternative embodiment represented in FIG. 1 corresponds to a preferred alternative embodiment wherein the mechanical system is configured so as to enable the mechanical braking device to apply a mechanical braking pulse to the slave mechanical resonator at any time of an oscillation period within the usable operating range of the slave oscillator. Indeed, the outer lateral surface 46 of the felloe 30 defines a continuous and circular braking surface, such that the pad 42 of the braking member 40 can exert a mechanical braking torque at any angular position of the balance-hairspring. Thus, a braking pulse may start at any angular position of the slave mechanical resonator between the two end angular positions (the two amplitudes of the slave oscillator respectively on both sides from the neutral position of the mechanical resonator thereof) which can be attained when the slave oscillator is operational.

It should be noted that the braking surface may be other than the outer lateral surface of the felloe of the balance. In an alternative embodiment not shown, it is the central shaft of the balance that defines a circular braking surface. In this case, a pad of the braking member is arranged so as to apply a pressure against this surface of the central shaft upon the application of the mechanical braking pulses.

In a general operating mode, the mechanical braking device 24 is arranged such that the periodic braking pulses each have essentially a duration of less than one quarter of the set-point period for the oscillation of the slave mechanical oscillator 18.

By way of non-limiting examples, for a main timepiece resonator formed by a balance-hairspring, wherein the constant of the hairspring k=5.75 E-7 Nm/rad and the inertia I=9.1 E-10 kg·m$^2$, and a set-point frequency F$\mathbf{0}_c$ equal to 4 Hz, it is possible to consider a first alternative embodiment for a timepiece movement, the non-synchronised running whereof is somewhat imprecise, with a daily error of about five minutes, and a second alternative embodiment for a further timepiece movement, the non-synchronised running whereof is more precise with a daily error of about thirty seconds. In the first alternative embodiment, the range of values for the average braking torque is between 0.2 μNm and 10 μNm, the range of values for the duration of the braking pulses is between 5 ms and 20 ms and the range of values relative to the braking period for the application of the periodic braking pulses is between 0.5 s and 3 s. In the second alternative embodiment, the range of values for the average braking torque is between 0.1 μNm and 5 μNm, the range of values for the duration of the periodic braking pulses is between 1 ms and 10 ms and the range of values for the braking period is between 3 s and 60 s, i.e. at least once per minute.

It should be noted that the slave main oscillator is not limited to a version comprising a balance-hairspring and an escapement with a stop pin, in particular of the Swiss lever type. Other mechanical oscillators can be envisaged, in particular with a flexible strip balance. The escapement can include a stop pin or be of the continuous rotating type. This is also true for the auxiliary mechanical oscillator forming the master oscillator. Since the master oscillator is the oscillator that ultimately gives the high precision sought for the running of the mechanical movement, an oscillator of the mechanical type is thus ideally selected therefor that is as precise as possible, bearing in mind that this oscillator does not need to drive the one or more mechanisms of the horological movement, in particular a time indicator mechanism. This is shown by the second embodiment of the invention described hereafter.

Figure 2A:
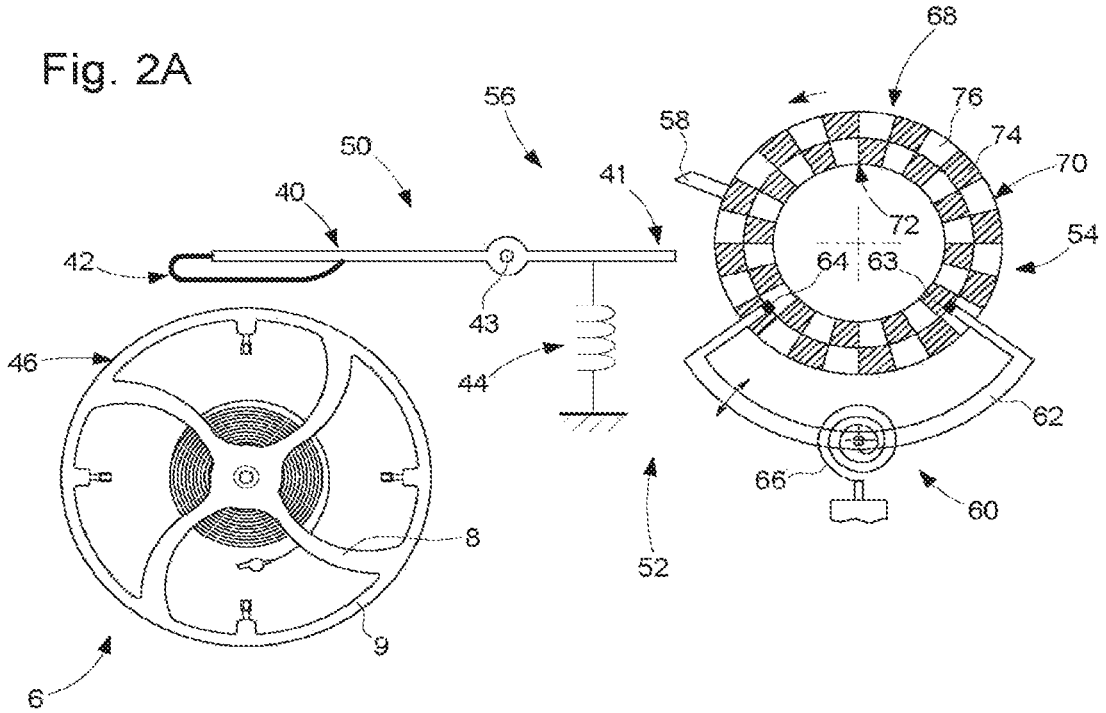

FIG. 2A shows a second embodiment of a timepiece according to the invention. So as not to overly complicate the drawing, only the slave main resonator 6 and the mechanical correction device 52 have been shown. The correction device is formed by a master mechanical oscillator 54 and by a mechanical braking device 56 which comprises a braking pulse generator mechanism 50 similar to that presented within the scope of the first embodiment.

The resonator 6, similar to that in FIG. 1, and the pulse generator 50 will not be described again in detail here.

The master oscillator 54 is of the magnetic escapement type. It comprises a resonator 60 formed by a balance 62 and a hairspring 66 (shown schematically). In an alternative embodiment, the balance is mounted on flexible strips. This balance comprises two arms, which are situated on two sides of the pivot axis thereof and which bear two magnets 63 and 64 at the respective ends thereof. These two magnets are used to couple the resonator 60 to an escapement wheel 68. This escapement wheel and the magnets 63 and 64 form the magnetic escapement of the master oscillator 54. The escapement wheel comprises a magnetic structure formed by two annular tracks 70 and 72. Each of the two annular tracks has an alternation of annular sectors 74 and 76, one sector 74 and one adjacent sector 76 jointly defining an angular period of the magnetic structure. The two tracks are angularly out of phase by half a period. As a whole, a sector 74 has at least one physical feature or defines at least one physical parameter, relative to the magnets borne by the balance, which is different from an analogous physical feature of a sector 76 or from an analogous physical parameter defined by a sector 76. In other words, the magnetic potential for any of the two magnets passing over a sector 74 is different from the magnetic potential that it has when passing over a sector 76. In particular, it is envisaged that a minimum magnetic potential appears in one of the two sectors, whereas a maximum magnetic potential appears in the other of these two sectors. Thus, if the escapement wheel rotates, it induces an oscillation of the resonator 60 at the natural oscillation frequency thereof, which thus imposes a continuous rotational speed on the escapement wheel as a function of the value of this oscillation frequency, hereafter referred to as the 'reference frequency'. The escapement wheel advances by one angular period of the magnetic structure per oscillation period of the balance 62. It should be noted that if it is the resonator that is directly excited and oscillates at the resonant frequency (natural frequency) thereof, then the escapement wheel is driven in rotation at the aforementioned continuous rotational speed. The term 'continuous rotational speed' is understood herein to mean that the wheel rotates without stopping; however, there can be a periodic variation in speed.

A plurality of alternative embodiments can be considered for the magnetic structure of the escapement wheel 68. In a first alternative embodiment, the sectors 74 are made of a ferromagnetic material, whereas the sectors 76 are made of a non-magnetic material. In a second alternative embodiment, the sectors 74 are made of a magnetised material, whereas the sectors 76 are made of a non-magnetic material. In a third alternative embodiment, the sectors 74 are made of a material that is magnetised in a first direction whereas the sectors 76 are made of a material that is magnetised in a second direction opposite to the first direction (opposite polarities). In the latter case, each of the two magnets 63 and 64 is subjected to a magnetic repulsion force above one of the two sectors and to a magnetic attraction force above the other sector Other perfected alternative embodiments are described in the patent application EP 2 891 930. Reference can be made to this document in order to better understand the functioning of the master oscillator 54.

The escapement wheel bears, at the periphery thereof, a finger 58 arranged such that it can actuate the pulse generator 50 at each revolution performed by the escapement wheel. This finger belongs to the braking device 56 and the role thereof is similar to that of a pin 38 of the first embodiment. Thus, the escapement wheel and the actuating finger 58 jointly form a control mechanism of the pulse generator 50. A sequence of the operation of the correction device of the second embodiment is given in FIGS. 2A to 2D.

Figure 2B:
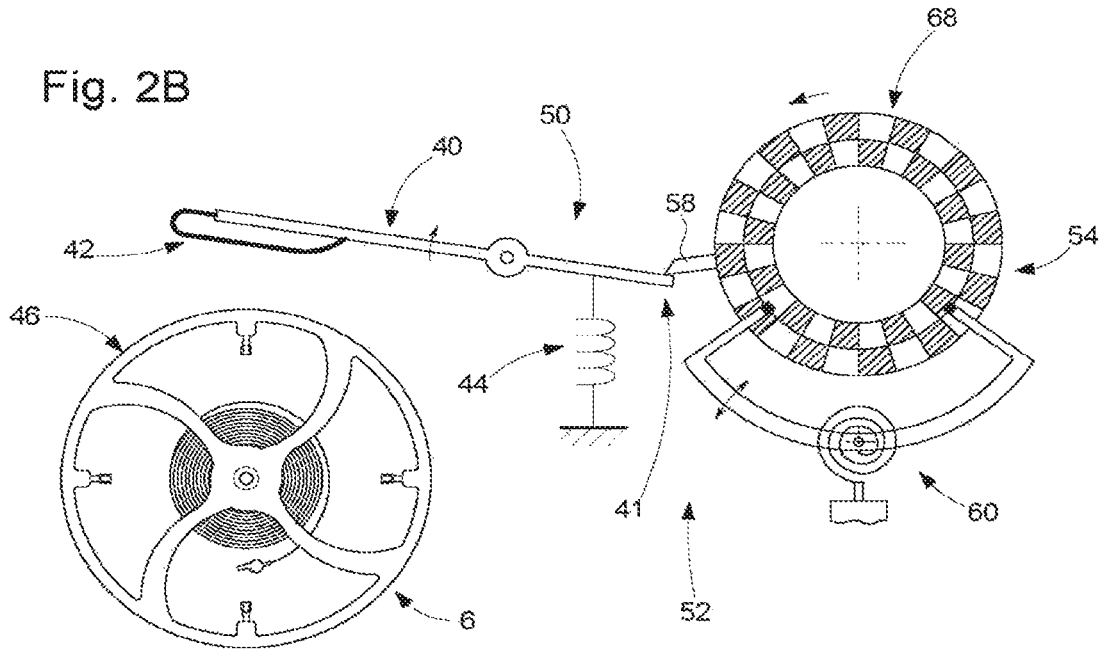
Figure 2C:
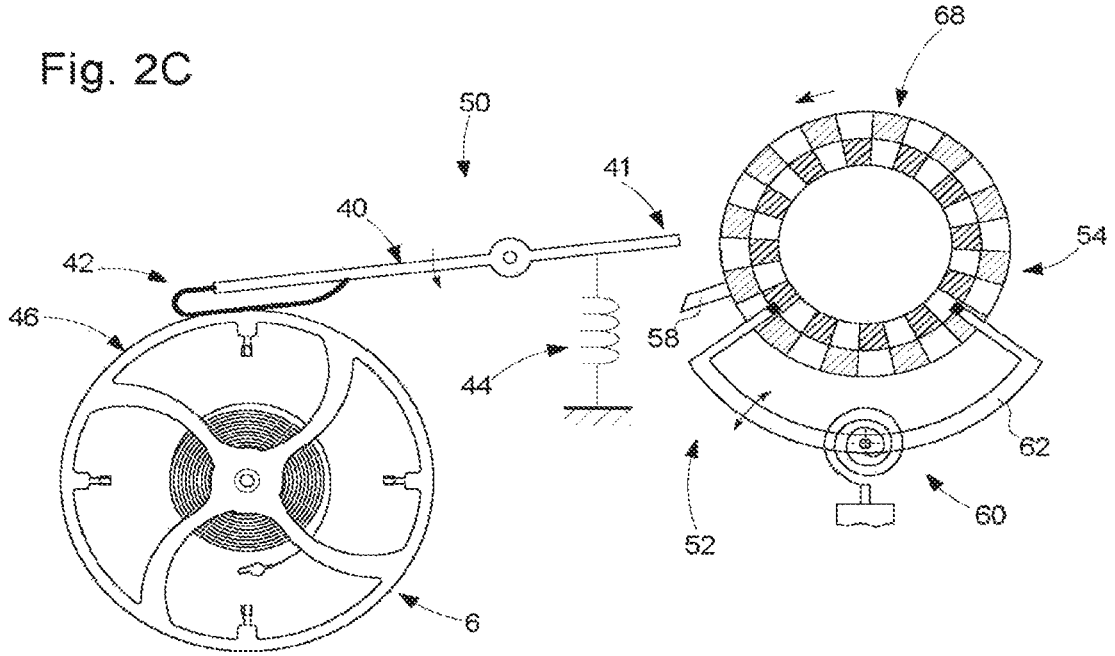
Figure 2D:
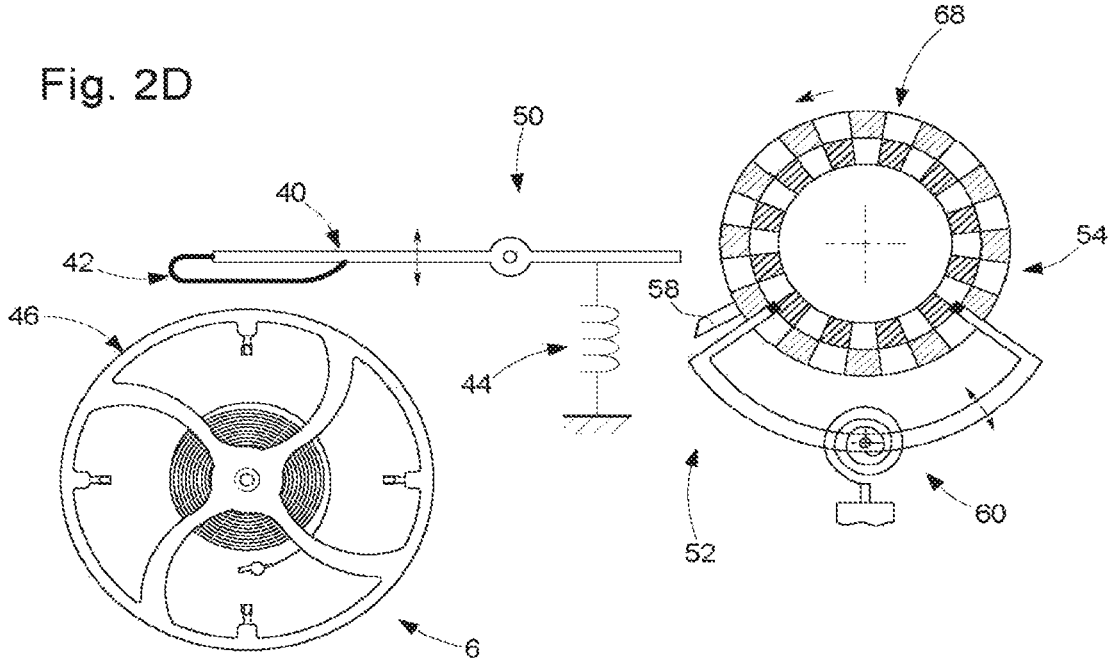

In FIG. 2A, the pulse generator 50 is idle and the actuating finger 58 gradually rotates in the direction thereof. In FIG. 2B, the actuating finger has come into contact with the end 41 of the lever 40 and the latter has begun to rotate in a clockwise direction. The pulse generator is thus armed. By continuing to rotate, the finger slides along the end 41 until a time when it loses contact with this end, which releases the lever and thus triggers the generation of a braking pulse, which event is shown in FIG. 2C. The previously compressed spring 44 drives, during a first oscillation, the lever in an anticlockwise direction and the strip spring 42, defining a braking pad, presses against the braking surface 46 of the felloe of the balance during a certain time interval. After the braking pulse, the lever rotates again in the clockwise direction during a second oscillation and then oscillates about the idle position of the pulse generator while being subjected to damping, as shown in FIG. 2D. Finally, the lever is stabilised and waits for the actuating finger to complete a new rotation.

For the purposes of illustration, the reference frequency of the master oscillator 54 is equal to 12 Hz and the magnetic structure of the escapement wheel has magnetic periods of 30°, i.e. a total of 12 periods. The braking pulse generator mechanism is thus actuated at a braking frequency of 1 Hz since the escapement wheel performs one revolution per second. In another alternative embodiment, the number of magnetic periods is equal to 24 such that the braking frequency is thus equal to 2 Hz.

Figure 3:
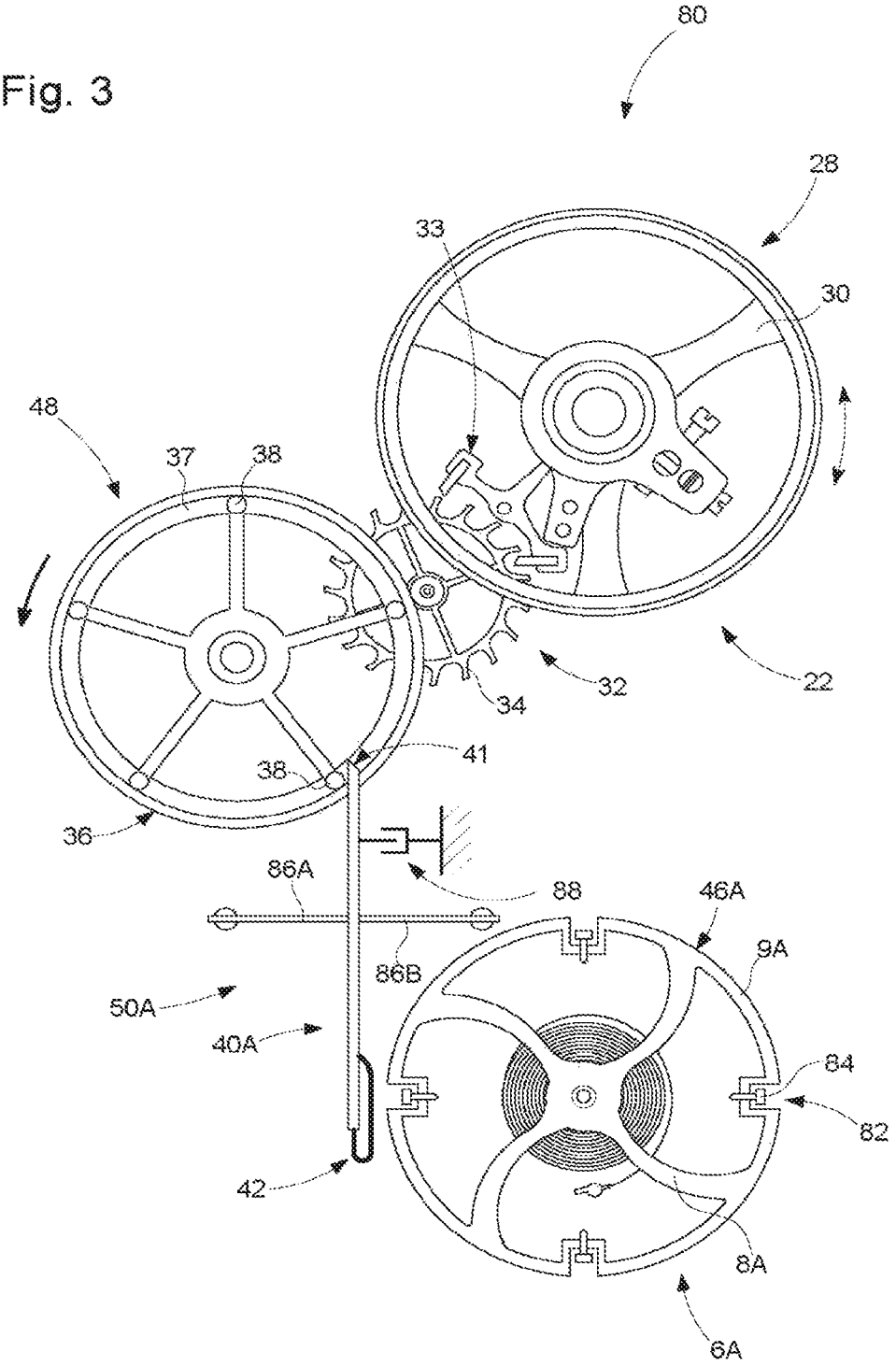

FIG. 3 shows a third embodiment of a timepiece according to the invention. The timepiece 80 (partially shown) differs from that in FIG. 1 merely by a few features of the slave main resonator 6A and of the braking pulse generator mechanism 50A. The resonator 6A comprises a felloe 9A having cavities 84 (in the general plane of the balance) wherein are housed screws 82 for balancing the balance. Thus, the outer lateral surface 46A of the balance no longer defines a continuous circular surface, but a discontinuous circular surface with four continuous angular sectors. It should be noted that the strip spring 42 has a contact surface with a range such that braking pulses remain possible for any angular position of the balance 8A, even when a cavity is presented facing the strip spring, as represented in FIG. 3. Then, the lever 40A of the pulse generator 50A is held in a central part by two elastic strips 86A and 86B which respectively extend on the two sides of the lever, which can thus pivot about a fictive axis defined by the two elastic strips. The two elastic strips are attached to two studs, each having a slot wherein a strip end is rigidly inserted. Finally, a shock absorber 88 is associated with the lever 40A so as to sufficiently damp the oscillation of this lever, after the generation of a first braking pulse, in order to prevent other significant braking pulses from being applied to the resonator 6A in a braking period after this first braking pulse.

Figure 4:
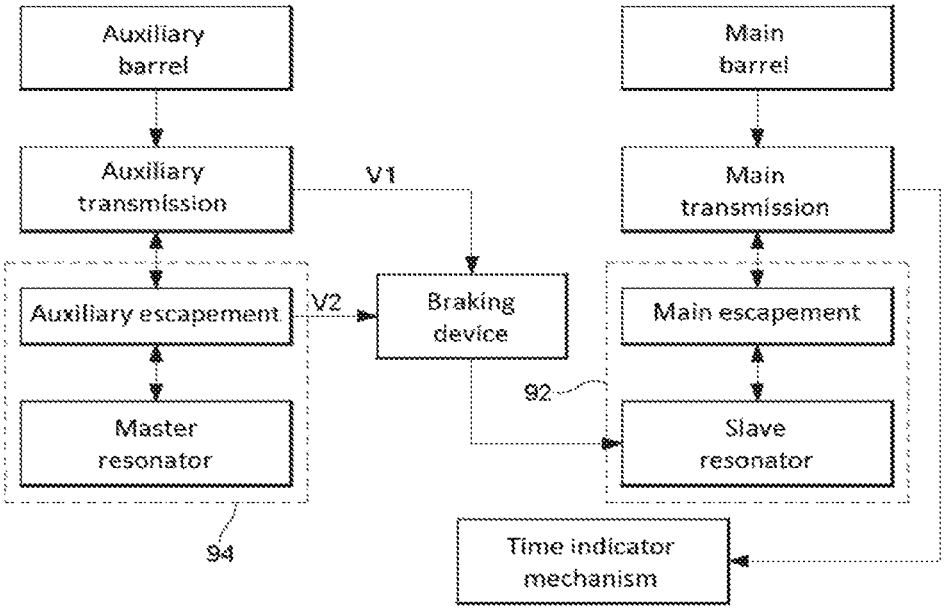
FIG. 4 shows schematically a first configuration of the general arrangement of a timepiece according to the invention.
Figure 5:
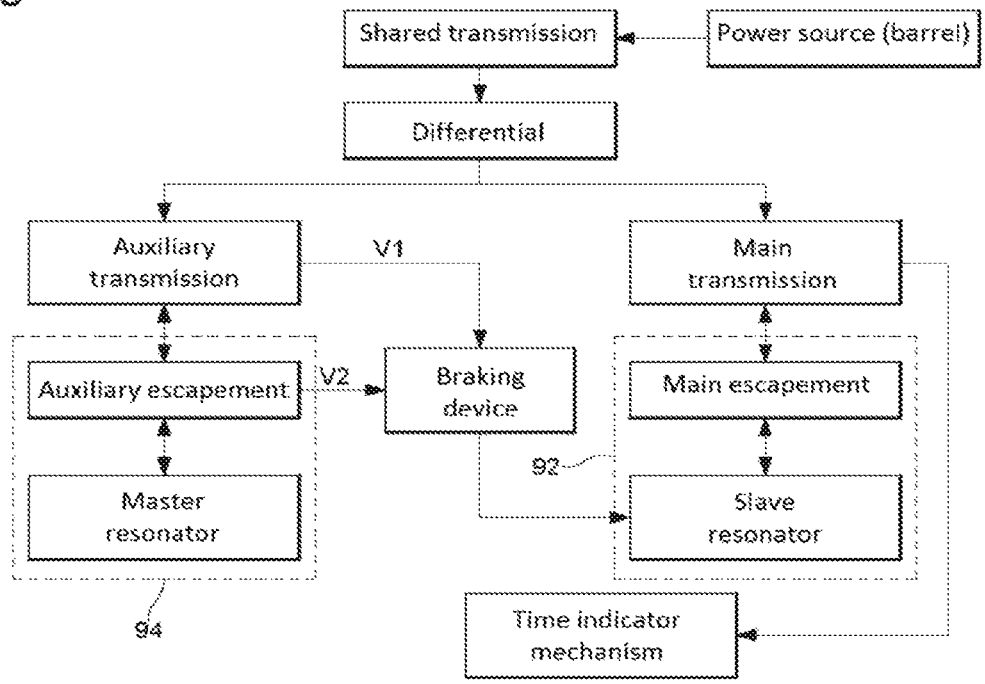
FIG. 5 shows schematically a second configuration of the general arrangement of a timepiece according to the invention.

FIGS. 4 and 5 show schematically two alternative configurations for the general arrangement of a timepiece according to the invention. FIG. 4 relates to a preferred arrangement that has been implemented in the aforementioned embodiments. On the one hand, the timepiece movement is produced with a main part wherein a main mechanical power source, formed by a main barrel, transmits the power thereof, via a main transmission, to a slave oscillator 92 and to a time indication mechanism, the running whereof is paced by this slave oscillator. According to the invention, a braking device is arranged such that it brakes the slave resonator, the intensity of this braking varying periodically at a braking frequency, as explained hereinabove. This braking device forms a part of a mechanical correction device independent of the elements of the main part of the mechanical movement. The mechanical correction device comprises an auxiliary mechanical power source formed by an auxiliary barrel which is separate from the main barrel. This auxiliary barrel supplies the power thereof, via an auxiliary transmission, firstly to the master oscillator 94 and secondly to the braking device. In the first embodiment, the power is supplied to the braking device via the auxiliary transmission (version V1), a wheel set of this auxiliary transmission forming a control mechanism of the pulse generator which not only determines the times at which the braking pulses are triggered, but also transmits the power required to arm this pulse generator. In the second embodiment, it is the escapement wheel that directly carries out these two functions with the actuating finger (version V2). This arrangement has the advantage of entirely separating the wheel sets linked to the slave oscillator from the wheel sets linked to the master oscillator. This prevents any possible coupling between the two oscillators, which could potentially affect the operation and the precision of the master oscillator. The only interaction envisaged between the slave oscillator and the master oscillator is constituted by the braking pulses.

FIG. 5 shows a general alternative arrangement that can be considered. It is characterised in that the main part of the timepiece movement and the correction device share the same, single power source, i.e. a barrel supplying the power thereof, via a shared transmission to a differential mechanism which distributes this power firstly to the slave oscillator 92 and to the time indication mechanism and secondly to the master oscillator 94 and to the braking device. It should be noted that this alternative does not prevent a plurality of barrels in series or in parallel from being used to supply power to the differential mechanism.

Before presenting further particular embodiments, the noteworthy operation of a timepiece according to the invention will be described in detail, in addition to how the synchronisation of the slave main oscillator on the master auxiliary oscillator is obtained.

The text hereinafter will describe, with reference to FIGS. 6 and 7, a remarkable physical phenomenon highlighted within the scope of developments having led to the present invention and involved in the synchronisation method implemented in the timepiece according to the invention. Understanding this phenomenon will make it possible to better understand the synchronisation obtained by the correction device regulating the running of the mechanical movement, this result being described in detail hereinafter.

Figure 6:
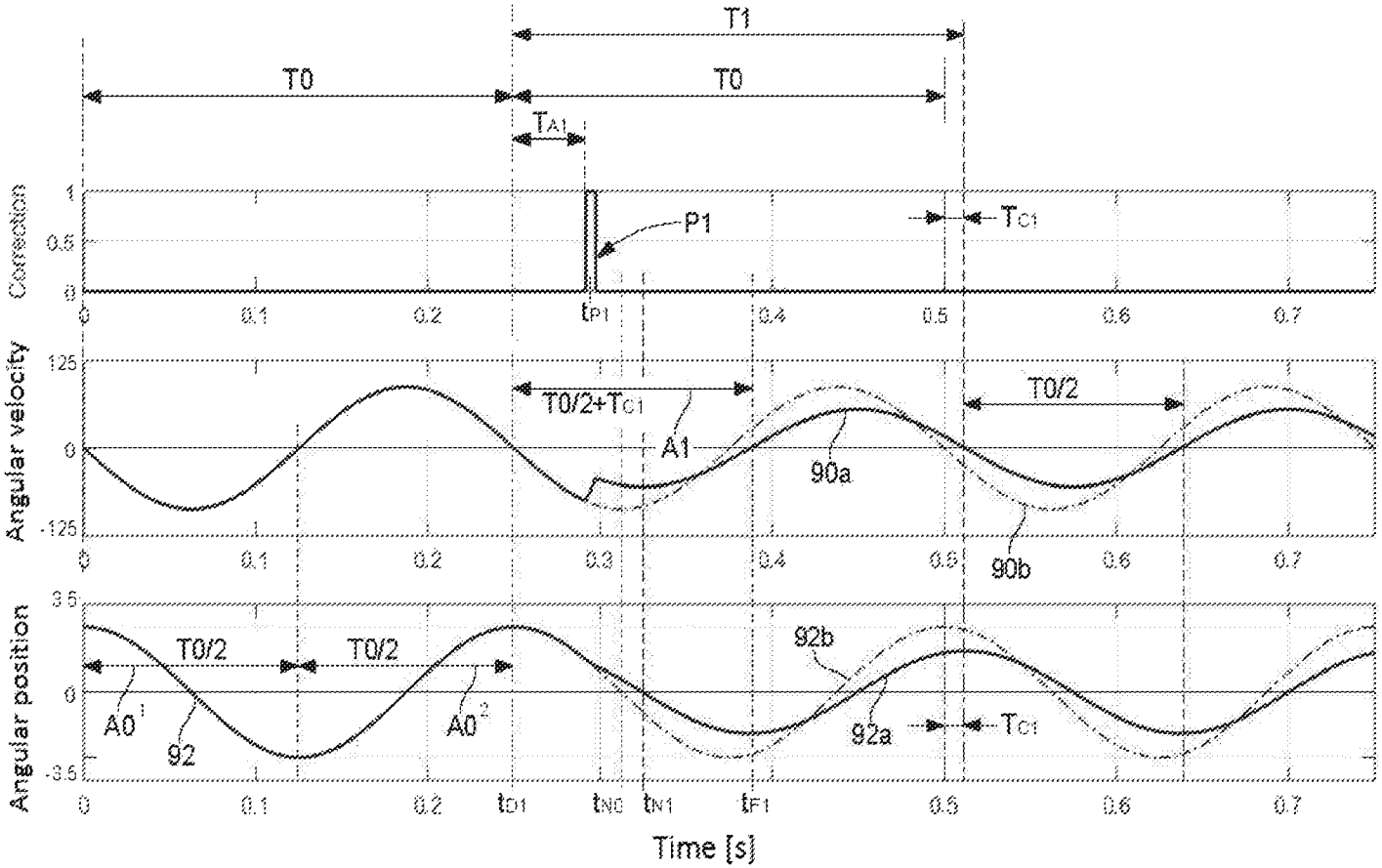
FIG. 6 shows the application of a first braking pulse to a mechanical resonator in a certain alternation of the oscillation thereof before it passes via the neutral position thereof, as well as the angular velocity of the balance of this mechanical resonator and the angular position thereof in a time interval wherein the first braking pulse occurs.
Figure 7:
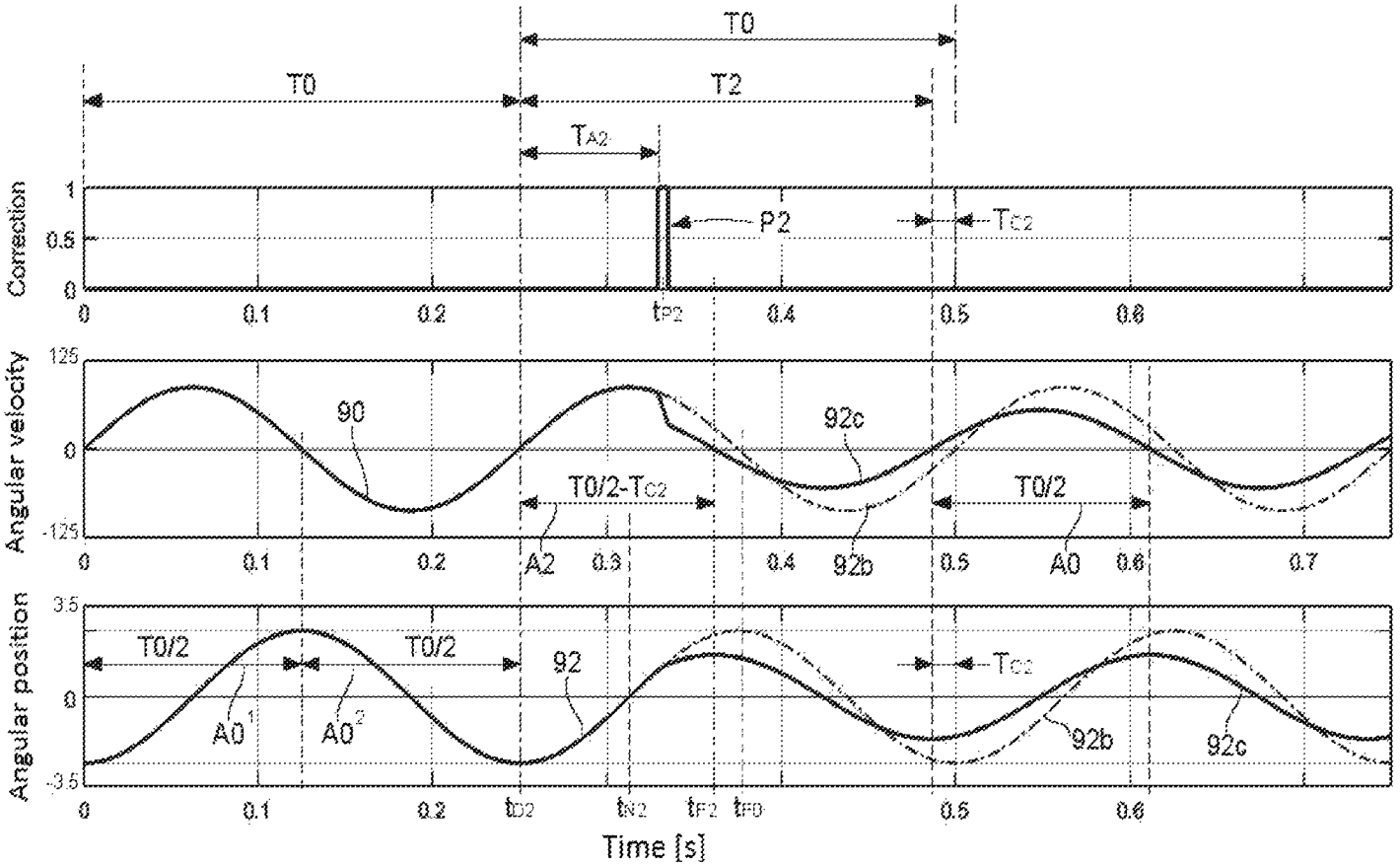
FIG. 7 is a figure similar to that in FIG. 6 but for the application of a second braking pulse in a certain alternation of the oscillation of a mechanical oscillator after it has passed via the neutral position thereof.

In FIGS. 6 and 7, the first graph shows the time $t_{P1}$ at which a braking pulse P1, respectively P2 is applied to the mechanical resonator in question to make a correction in the running of the mechanism paced by the mechanical oscillator formed by this resonator. The latter two graphs show respectively the angular velocity (values in radian per second: [rad/s]) and the angular position (values in radian: [rad]) of the oscillating member (hereinafter also 'the balance') of the mechanical resonator over time. The curves 90 and 92 correspond respectively to the angular velocity and to the angular position of the balance oscillating freely (oscillation at the natural frequency thereof) before the occurrence of a braking pulse. After the braking pulse, the velocity curves 90*a* and 90*b* are shown, corresponding to the behaviour of the resonator respectively in the scenario with disturbance from the braking pulse and in the non-disturbed scenario. Similarly, the position curves 92*a* and 92*b* correspond to the behaviour of the resonator respectively in the scenario with disturbance from the braking pulse and in the non-disturbed scenario. In the figures, the times $t_{P1}$ and $t_{P2}$ at which the braking pulses P1 and P2 occur correspond to the time positions of the midpoint of these pulses. However, the start of the braking pulses and the duration thereof are considered to be the two parameters defining a braking pulse in terms of time.

It should be noted that the pulses P1 and P2 are represented in FIGS. 6 and 7 by binary signals. However, in the explanations hereinafter, mechanical braking pulses applied to the mechanical resonator and not control pulses are considered. Thus, it should be noted that, in certain embodiments, in particular with mechanical correction devices having a mechanical control device, the control pulse may occur at least in part before the application of a mechanical braking pulse. In such a case, in the following explanations, the braking pulses P1, P2 correspond to the mechanical braking pulses applied to the resonator and not to prior control pulses.

It should further be noted that the braking pulses may be applied with a constant force couple or a non-constant force couple (for example substantially in a Gaussian or sinusoidal curve). The term 'braking pulse' denotes the momentary application of a force couple to the mechanical resonator which brakes the oscillating member thereof (balance), i.e. which opposes the oscillation movement of this oscillating member. In the case of a couple different to zero which is variable, the duration of the pulse is defined generally as the part of this pulse which has a significant force couple to brake the mechanical resonator. It should be noted that a braking pulse may exhibit a significant variation. It may even be choppy and form a succession of shorter pulses. In the case of a constant couple, the duration of each pulse is envisaged to be less than a half of a set-point period and preferably less than a quarter of a set-point period. It should be noted that each braking pulse may either brake the mechanical resonator without however stopping same, as in FIGS. 6 and 7, or stop it during the braking pulse and stop it momentarily during the remainder of this braking pulse.

Each free oscillation period T0 of the mechanical oscillator defines a first alternation $A0^1$ followed by a second alternation $A0^2$ each occurring between two end positions defining the oscillation amplitude of this mechanical oscillator, each alternation having an identical duration T0/2 and exhibiting a passage of the mechanical resonator via the zero position thereof at a median time. The two successive alternations of an oscillation define two half-periods during which the balance respectively sustains an oscillation movement in one direction and subsequently an oscillation movement in the other direction. In other words, an alternation corresponds to an oscillation of the balance in one direction or the other between the two end positions thereof defining the oscillation amplitude. As a general rule, a variation in the oscillation period during which a braking pulse occurs and therefore an isolated variation of the frequency of the mechanical oscillator are observed. In fact, the time variation relates to the sole alternation during which the braking pulse occurs. The term 'median time' denotes a time occurring substantially at the midpoint of the alternations. This is specifically the case when the mechanical oscillator oscillates freely. On the other hand, for the alternations during which regulation pulses occur, this median time no longer corresponds exactly to the midpoint of the duration of each of these alternations due to the disturbance of the mechanical oscillator induced by the regulation device.

The behaviour of the mechanical oscillator in a first correction scenario of the oscillation frequency thereof, which corresponds to that shown in FIG. 6, will now be described. After a first period T0 then commences a new period T1, respectively a new alternation A1 during which a braking pulse P1 occurs. The alternation A1 starts at the initial time $t_{D1}$, the resonator 14 occupying a maximum positive angular position corresponding to an end position. Then the braking pulse P1 occurs at the time $t_{P1}$ which is situated before the median time $t_{N1}$ at which the resonator passes via the neutral position thereof and therefore also before the corresponding median time $t_{N0}$ of the non-disturbed oscillation. Finally, the alternation A1 ends at the end time $t_{F1}$. The braking pulse is triggered after a time interval $T_{A1}$ following the time $t_{D1}$ marking the start of the alternation A1. The duration $T_{A1}$ is less than a half-alternation T0/4 less the duration of the braking pulse P1. In the example given, the duration of this braking pulse is considerably less than a half-alternation T0/4.

In this first case, the braking pulse is therefore generated between the start of an alternation and the passage of the resonator via the neutral position thereof in this alternation. The angular velocity in absolute values decreases during the braking pulse P1. Such a braking pulse induces a negative time phase shift $T_{C1}$ in the oscillation of the resonator, as shown in FIG. 6 by the two curves 90*a* and 90*b* of the angular velocity and also the two curves 92*a* and 92*b* of the angular position, i.e. a delay relative to the non-disturbed theoretical signal (shown with broken lines). Thus, the duration of the alternation A1 is increased by a time interval $T_{C1}$. The oscillation period T1, comprising the alternation A1, is therefore extended relative to the value T0. This induces an isolated decrease in the frequency of the mechanical oscillator and a momentary slowing-down of the associated mechanism, the running whereof is paced by this mechanical oscillator.

With reference to FIG. 7, the behaviour of the mechanical oscillator in a second correction scenario of the oscillation frequency thereof will be described hereinafter. After a first period T0 then commences a new oscillation period T2, respectively an alternation A2 during which a braking pulse P2 occurs. The alternation A2 starts at the initial time $t_{D2}$, the mechanical resonator then being in an end position (maximum negative angular position). After a quarter-period T0/4 corresponding to a half-alternation, the resonator reaches the neutral position thereof at the median time $t_{N2}$. Then the braking pulse P2 occurs at the time $t_{P2}$ which is situated in the alternation A2 after the median time $t_{N2}$ at which the resonator passes via the neutral position thereof. Finally, after the braking pulse P2, this alternation A2 ends at the end time $t_{F2}$ at which the resonator once again occupies an end position (maximum positive angular position in the period T2) and therefore also before the corresponding end time $t_{F0}$ of the non-disturbed oscillation. The braking pulse is triggered after a time interval $T_{A2}$ following the initial time $t_{D2}$ of the alternation A2. The duration $T_{A2}$ is greater than a half-alternation T0/4 and less than an alternation T0/2 less the duration of the braking pulse P2. In the example given, the duration of this braking pulse is considerably less than a half-alternation.

In the second scenario in question, the braking pulse is therefore generated, in an alternation, between the median time at which the resonator passes via the neutral position thereof (zero position) and the end time at which this alternation ends. The angular velocity in absolute values decreases during the braking pulse P2. Remarkably, the braking pulse induces in this case a positive time phase shift $T_{C2}$ in the oscillation of the resonator, as shown in FIG. 4 by the two curves 90*b* and 90*c* of the angular velocity and also the two curves 92*b* and 92*c* of the angular position, i.e. an advance relative to the non-disturbed theoretical signal (shown with broken lines). Thus, the duration of the alternation A2 is decreased by the time interval $T_{C2}$. The oscillation period T2, comprising the alternation A2, is therefore shorter than the value T0. This induces an isolated increase in the frequency of the mechanical oscillator and a momentary acceleration of the associated mechanism, the running whereof is paced by this mechanical oscillator. This phenomenon is surprising and not obvious, which is the reason why those skilled in the art have ignored it in the past. Indeed, obtaining an acceleration of the mechanism by a braking pulse is in principle surprising, but this is indeed the case when this running is paced by a mechanical oscillator and the braking pulse is applied to the resonator thereof.

The physical phenomenon mentioned above for mechanical oscillators is involved in the synchronisation method implemented in a timepiece according to the invention. Unlike the general teaching in the field of timepieces, it is possible not only to reduce the frequency of a mechanical oscillator with braking pulses, but it is also possible to increase the frequency of such a mechanical oscillator also with braking pulses. Those skilled in the art would expect to be able to practically only reduce the frequency of a mechanical oscillator with braking pulses and, by way of corollary, to be able to only increase the frequency of such a mechanical oscillator by applying drive pulses when supplying power to said oscillator. Such an intuitive idea, which has become established in the field of timepieces and therefore comes first to the mind of those skilled in the art, proves to be incorrect for a mechanical oscillator. Thus, as described in detail hereinafter, it is possible to synchronise, via an auxiliary oscillator defining a master oscillator, a mechanical oscillator that is very precise moreover, whether it momentarily has a frequency that is slightly too high or too low. It is therefore possible to correct a frequency that is too high or a frequency that is too low merely by means of braking pulses. In sum, applying a braking couple during an alternation of the oscillation of a balance-hairspring induces a negative or positive phase shift in the oscillation of this balance-hairspring according to whether said braking torque is applied respectively before or after the passage of the balance-hairspring via the neutral position thereof.

Figures 8A, 8B, 8C:
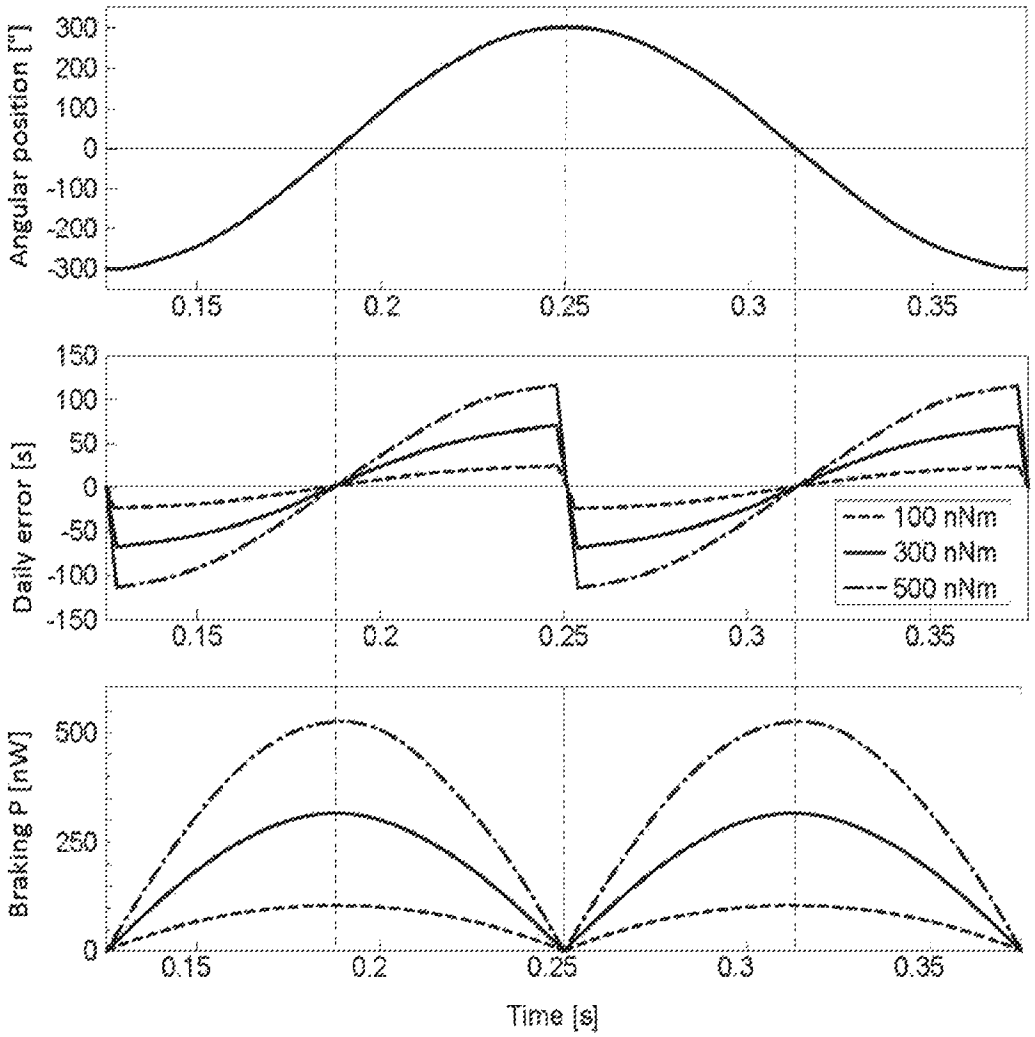
FIGS. 8A, 8B and 8C show respectively the angular position of a balance-hairspring during an oscillation period, the variation of the running of the timepiece movement obtained for a braking pulse of fixed duration, for three values of a constant braking torque, according to the angular position of the balance-hairspring, and the corresponding braking power.

The resulting synchronisation method of the correction device incorporated in a timepiece according to the invention is described hereinafter. FIG. 8A shows the angular position (in degrees) of a timepiece mechanical resonator oscillating with an amplitude of 300° during an oscillation period of 250 ms. FIG. 8B shows the daily error generated by braking pulses of one millisecond (1 ms) applied in successive oscillation periods of the mechanical resonator according to the time of the application thereof within these periods and therefore according to the angular position of the mechanical resonator. This case is based on the fact that the mechanical oscillator functions freely at a natural frequency of 4 Hz (non-disturbed scenario). Three curves are given respectively for three force couples (100 nNm, 300 nNm and 500 nNm) applied by each braking pulse. The result confirms the physical phenomenon described above, namely that a braking pulse occurring in the first quarter-period or the third quarter-period induces a delay stemming from a decrease in the frequency of the mechanical oscillator, whereas a braking pulse occurring in the second quarter-period or the fourth quarter-period induces an advance stemming from an increase in the frequency of the mechanical oscillator. Then, it is observed that, for a given force couple, the daily error is equal to zero for a braking pulse occurring at the neutral position of the resonator, this daily error increasing (in absolute values) on approaching an end position of the oscillation. At this end position where the velocity of the resonator passes via zero and where the direction of the movement changes, there is a sudden inversion of the sign of the daily error. Finally, FIG. 8C gives the braking power consumed for the three force couple values mentioned above as a function of the time of application of the braking pulse during an oscillation period. As the velocity decreases on approaching the end positions of the resonator, the braking power also decreases. Thus, while the daily error induced increases on approaching the end positions, the braking power required (and therefore the energy lost by the oscillator) decreases significantly.

The error induced in FIG. 8B may correspond in fact to a correction for the scenario where the mechanical oscillator has a natural frequency which does not correspond to a set-point frequency. Thus, if the oscillator has a natural frequency that is too low, braking pulses occurring in the second or fourth quarter of the oscillation period may enable a correction of the delay adopted by the free (non-disturbed) oscillation, this correction being more or less substantial according to the time of the braking pulses within the oscillation period. On the other hand, if the oscillator has a natural frequency that is too high, braking pulses occurring in the first or third quarter of the oscillation period may enable a correction of the advance adopted by the free oscillation, this correction being more or less substantial according to the time of the braking pulses within the oscillation period.

The teaching given above makes it possible to understand the remarkable phenomenon of the synchronisation of a main mechanical oscillator (slave oscillator) on an auxiliary mechanical oscillator, forming a master oscillator, by the mere periodic application of braking pulses on the slave mechanical resonator at a braking frequency $F_{FR}$ corresponding advantageously to double the set-point frequency $F\mathbf{0}_c$ divided by a positive whole number N, i.e. $F_{FR}=2F\mathbf{0}_c/N$. The braking frequency is thus proportional to the set-point frequency for the master oscillator and merely dependent on this set-point frequency once the positive whole number N is given. As the set-point frequency is envisaged to be equal to a fractional number multiplied by the reference frequency, the braking frequency is therefore proportional to the reference frequency and determined by this reference frequency, which is supplied by the auxiliary mechanical oscillator which is by nature or by design more precise than the main mechanical oscillator.

The synchronisation mentioned above obtained by the correction device incorporated in the timepiece according to the invention will now be described in more detail with the aid of FIGS. 9 to 22.

Figure 9:
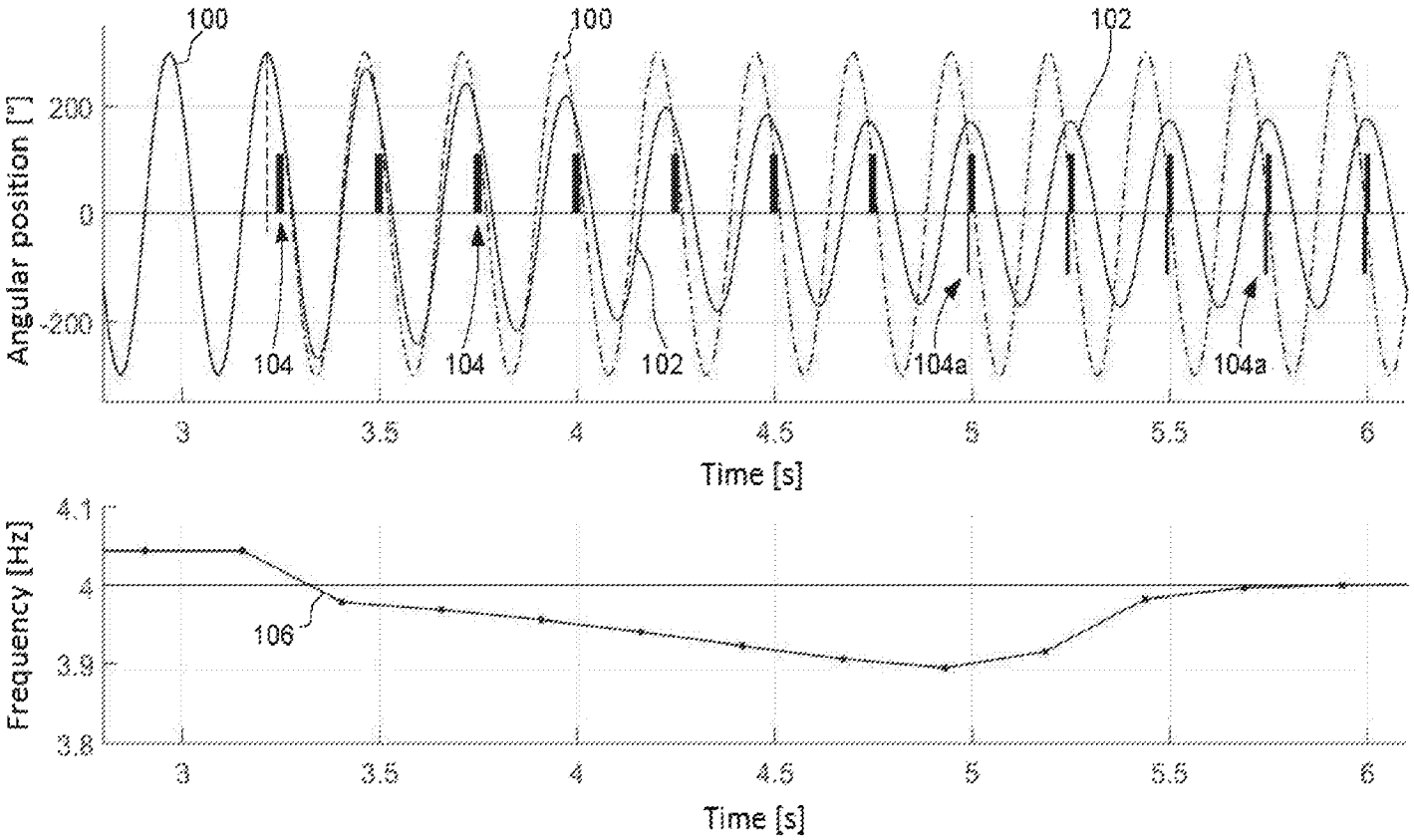
FIGS. 9, 10 and 11 show respectively three different scenarios liable to arise in an initial phase following the engagement of the correction device in a timepiece according to the invention.

FIG. 9 shows, on the top graph, the angular position of the slave mechanical resonator, particularly of the balance-hairspring of a timepiece resonator, oscillating freely (curve 100) and oscillating with braking (curve 102). The frequency of the free oscillation is greater than the set-point frequency $F\mathbf{0}_c$=4 Hz. The first mechanical braking pulses 104 (hereinafter also referred to as 'pulses') occur in this case once per oscillation period in a half-alternation between the passage via an end position and the passage via zero. This choice is arbitrary as the system envisaged does not detect the angular position of the mechanical resonator; this is therefore merely a possible hypothesis among others which will be analysed hereinafter. Therefore, the scenario of a slowing-down of the mechanical oscillator is observed in this case. The braking torque for the first braking pulse is envisaged in this case to be greater than a minimum braking torque to compensate for the advance adopted by the free oscillator over an oscillation period. This results in the second braking pulse taking place slightly before the first within the quarter-period wherein these pulses occur. The curve 106, which gives the instantaneous frequency of the mechanical oscillator, indeed indicates that the instantaneous frequency falls below the set-point frequency from the first pulse. Thus, the second braking pulse is closer to the preceding end position, such that the braking effect increases and so on with the subsequent pulses. In a transitory phase, the instantaneous frequency of the oscillator decreases therefore progressively and the pulses move closer progressively to an end position of the oscillation. After a certain time, the braking pulses comprise the passage via the end position where the velocity of the mechanical resonator changes direction and the instantaneous frequency then starts to increase.

The braking is characterised in that it opposes the movement of the resonator regardless of the direction of the movement thereof. Thus, when the resonator passes via an inversion of the direction of the oscillation thereof during a braking pulse, the braking torque automatically changes sign at the time of this inversion. This gives braking pulses 104*a* which have, for the braking torque, a first part with a first sign and a second part with a second sign opposite the first sign. In this scenario, the first part of the signal therefore occurs before the end position and opposes the effect of the second part which occurs after this end position. While the second part reduces the instantaneous frequency of the mechanical oscillator, the first part increases same. The correction then decreases to stabilise eventually and relatively quickly at a value for which the instantaneous frequency of the oscillator is equal to the set-point frequency (corresponding in this case to the braking frequency). Thus, the transitory phase is succeeded by a stable phase, also referred to as synchronous phase, where the oscillation frequency is substantially equal to the set-point frequency and where the first and second parts of the braking pulses have a substantially constant and defined ratio.

Figure 10:
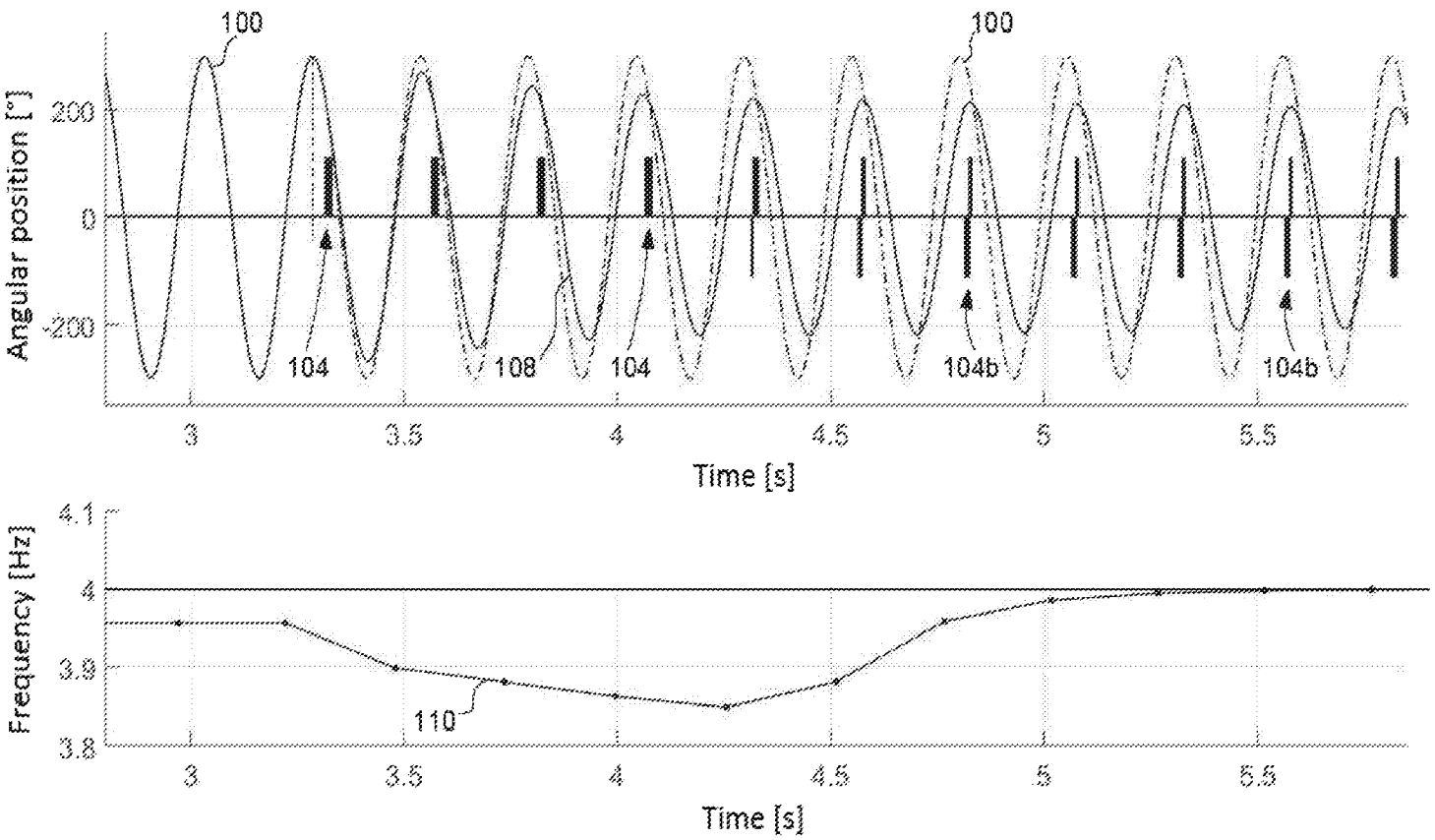

The graphs in FIG. 10 are equivalent to those in FIG. 9. The major difference is the value of the natural frequency of the free mechanical oscillator which is less than the set-point frequency $F\mathbf{0}_c$=4 Hz. The first pulses 104 occur in the same half-alternation as in FIG. 9. As expected, a decrease in the instantaneous frequency given by the curve 110 is observed. The oscillation with braking 108 therefore adopts momentarily more delay in the transitory phase, until the pulses 104*b* start to encompass the passage of the resonator via an end position. From this time, the instantaneous frequency starts to increase until it reaches the set-point frequency, as the first part of the pulses occurring before the end position increases the instantaneous frequency. This phenomenon is automatic. Indeed, while the duration of the oscillation periods is greater than the duration of the set-point period $T\mathbf{0}_c$, the first part of the pulse increases while the second part decreases and consequently the instantaneous frequency continues to increase to a stable status where the set-point period is substantially equal to the oscillation period. Therefore, the desired synchronisation is obtained.

Figure 11:
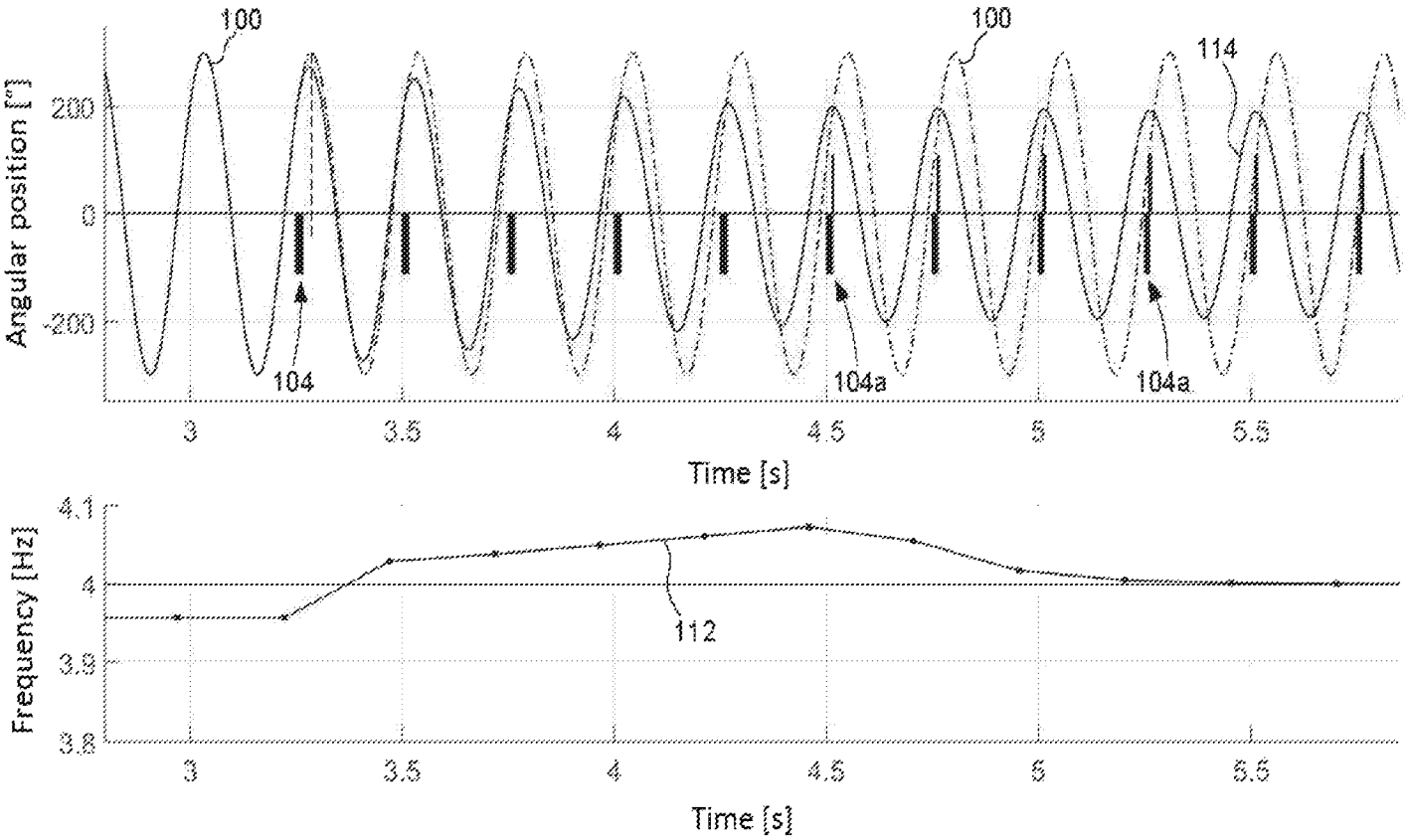

The graphs in FIG. 11 are equivalent to those in FIG. 10. The major difference is in that the first braking pulses 114 occur in another half-alternation than in FIG. 10, namely in a half-alternation between the passage via zero and the passage via an end position. As described above, in a transitory phase, an increase in the instantaneous frequency given by the curve 112 is observed in this case. The braking torque for the first braking pulse is envisaged in this case to be greater than a minimum braking torque to compensate for the delay adopted by the free mechanical oscillator over an oscillation period. This results in the second braking pulse taking place slightly after the first within the quarter-period wherein these pulses occur. The curve 112 shows indeed that the instantaneous frequency of the oscillator increases above the set-point frequency from the first pulse. Thus, the second braking pulse is closer to the subsequent end position, such that the braking effect increases and so on with the subsequent pulses. In the transitory phase, the instantaneous frequency of the oscillation with braking 114 therefore increases and the braking pulses move closer progressively to an end position of the oscillation. After a certain time, the braking pulses comprise the passage via the end position where the velocity of the mechanical resonator changes direction. From that time, a similar phenomenon to that described above is observed. The braking pulses 114*a* then have two parts and the second part reduces the instantaneous frequency. This decrease in the instantaneous frequency continues until it has a value equal to the set-point value for the same reasons as given with reference to FIGS. 9 and 10. The decrease in frequency stops automatically when the instantaneous frequency is substantially equal to the set-point frequency. A stabilisation of the frequency of the mechanical oscillator at the set-point frequency in a synchronous phase is then obtained.

Figure 12:
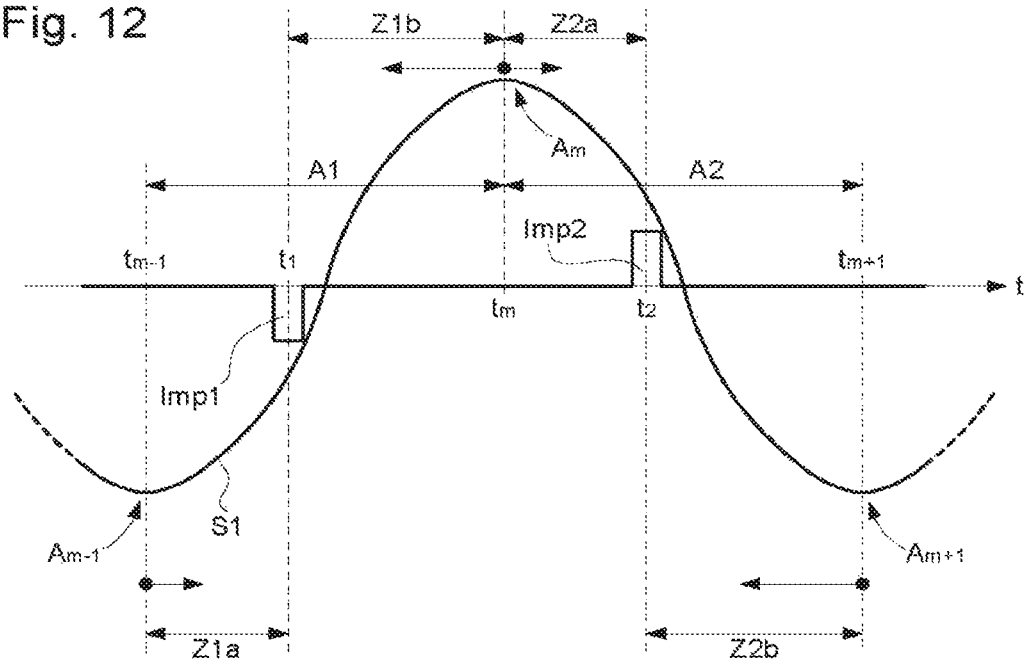
FIG. 12 is an explanatory graph of the physical process arising following the engagement of the correction device in the timepiece according to the invention and resulting in the synchronisation sought for the scenario where the natural frequency of the slave mechanical oscillator is greater than the set-point frequency.

With the aid of FIGS. 12 to 15, the behaviour of the mechanical oscillator in the transition phase for any time where a first braking pulse occurs during an oscillation period will be described, as well as the final scenario corresponding to the synchronous phase where the oscillation frequency is stabilised on the set-point frequency. FIG. 12 represents an oscillation period with the curve S1 of the positions of a mechanical resonator. In the scenario in question in this case, the natural oscillation frequency F0 of the free mechanical oscillator (with no braking pulses) is greater than the set-point frequency $F0_c$ ($F0>F0_c$). The oscillation period comprises conventionally a first alternation A1 followed by a second alternation A2, each between two end positions ($t_{m-1}$, $A_{m-1}$; $t_m$, $A_m$; $t_{m+1}$, $A_{m+1}$) corresponding to the oscillation amplitude. Then, in the first alternation, a braking pulse 'Imp1' is shown, the midpoint time position whereof occurs at a time $t_1$ and, in the second alternation, a further braking pulse 'Imp2' is shown, the midpoint time position whereof occurs at a time $t_2$. The pulses Imp1 and Imp2 exhibit a phase shift of T0/2, and they are characterised in that they correspond, for a given braking torque profile, to corrections inducing two unstable equilibria of the system. As these pulses occur respectively in the first and the third quarter of the oscillation period, they therefore brake the mechanical oscillator to a degree which makes it possible exactly to correct the excessively high natural frequency of the free mechanical oscillator (with the braking frequency selected for the application of the braking pulses). It should be noted that the pulses Imp1 and Imp2 are both first pulses, each being considered on its own in the absence of the other. It should be observed that the effects of the pulses Imp1 and Imp2 are identical.

If a first pulse occurs at the time $t_1$ or $t_2$, there will therefore be theoretically a repetition of this scenario during the next oscillation periods and an oscillation frequency equal to the set-point frequency. Two things should be noted for such a scenario. Firstly, the probability of a first pulse occurring exactly at the time $t_1$ or $t_2$ is relatively low though possible. Secondly, should such a particular scenario arise, it would not be able to last for a long time. Indeed, the instantaneous frequency of a balance-hairspring in a timepiece varies slightly over time for various reasons (oscillation amplitude, temperature, change of spatial orientation, etc.). Although these reasons represent disturbances that it is generally sought to minimise in fine watchmaking, the fact remains that, in practice, such an unstable equilibrium will not last very long. It should be noted that the higher the braking torque, the closer the times $t_1$ and $t_2$ are to the two passage times of the mechanical resonator via the neutral position thereof following same respectively. It should also be noted that the greater the difference between the natural oscillation frequency F0 and the set-point frequency $F0_c$, the closer the times $t_1$ and $t_2$ are also to the two passage times of the mechanical resonator via the neutral position thereof following same respectively.

Let us now consider what happens when deviating slightly from the time positions $t_1$ or $t_2$ during the application of the pulses. According to the teaching given with reference to FIG. 8B, if a pulse occurs to the left (prior time position) of the pulse Imp1 in the zone Z1*a*, the correction increases such that during subsequent periods, the preceding end position $A_{m-1}$ will progressively approach the braking pulse. On the other hand, if a pulse occurs to the right (subsequent time position) of the pulse Imp1, to the left of the zero position, the correction decreases such that during the subsequent periods the pulses drift towards this zero position where the correction becomes nil. Indeed, the effect of the pulse changes and an increase in the instantaneous frequency occurs. As the natural frequency is already too high, the pulse will rapidly drift to the end position $A_m$. Thus, if a pulse takes place to the right of the pulse Imp1 in the zone Z1*b*, the subsequent pulses will progressively approach the subsequent end position $A_m$. The same behaviour is observed in the second alternation A2. If a pulse takes place to the left of the pulse Imp2 in the zone Z2*a*, the subsequent pulses will progressively approach the preceding end position $A_m$. On the other hand, if a pulse takes place to the right of the pulse Imp2 in the zone Z2*b*, the subsequent pulses will progressively approach the subsequent end position $A_{m+1}$. It should be noted that this formulation is relative as in fact the application frequency of the braking pulses is set by the master oscillator (given braking frequency), such that it is the oscillation periods that vary and hence it is the end position in question that approaches the application time of a braking pulse. In conclusion, if a pulse occurs in the first alternation A1 at a time other than $t_1$, the instantaneous oscillation frequency progresses in a transitory phase during the subsequent oscillation periods such that one of the two end positions of this first alternation (positions of inversion of the direction of movement of the mechanical resonator) progressively approaches the braking pulses. The same applies for the second alternation A2.

Figure 13:
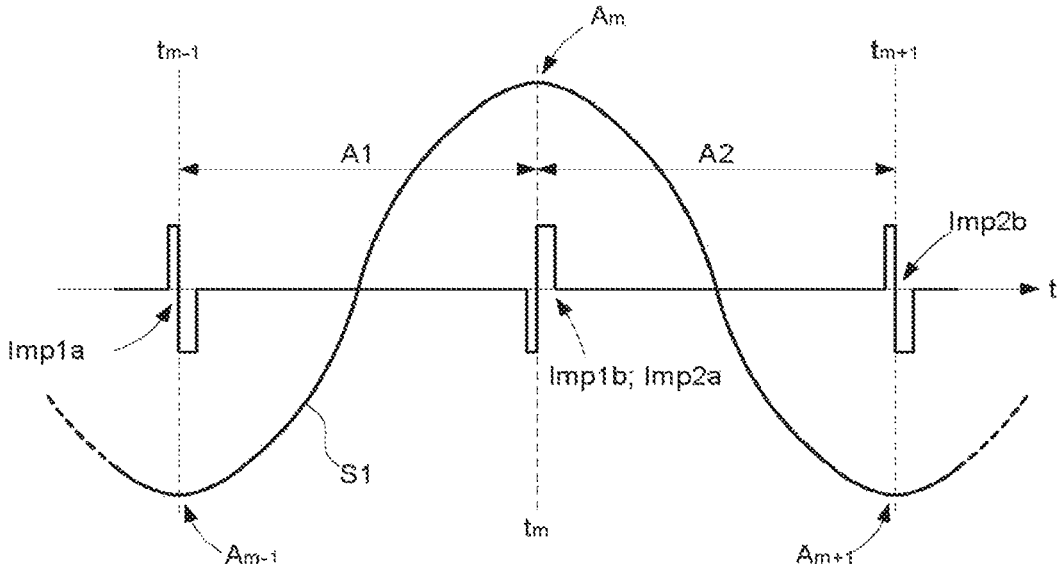
FIG. 13 represents, in the scenario of FIG. 12, an oscillation of the slave mechanical oscillator and the braking pulses in a stable synchronous phase for an alternative embodiment where a braking pulse occurs in each alternation.

FIG. 13 shows the synchronous phase corresponding to a final stable status occurring after the transitory phase described above. As previously explained, once the passage via an end position occurs during a braking pulse, this end position will be aligned with the braking pulses provided that these braking pulses are configured (the force couple and the duration) to be able to correct the time drift of the free mechanical oscillator sufficiently, at least with a braking pulse occurring entirely, depending on the case, just before or just after an end position. Thus, in the synchronous phase, if a first pulse occurs in the first alternation A1, either the end position $A_{m-1}$ of the oscillation is aligned with the pulses Imp1*a*, or the end position $A_m$ of the oscillation is aligned with the pulses Imp1*b*. In the case of a substantially constant couple, the pulses Imp1*a* and Imp1*b* each have a first part, the duration whereof is shorter than that of the second part thereof, so as to correct exactly the difference between the natural frequency that is too high of the slave main oscillator and the set-point frequency set by the master auxiliary oscillator. Similarly, in the synchronous phase, if a first pulse occurs in the second alternation A2, either the end position $A_m$ of the oscillation is aligned with the pulses Imp2*a*, or the end position $A_{m+1}$ of the oscillation is aligned with the pulses Imp2*b*.

It should be noted that the pulses Imp1*a*, respectively Imp1*b*, Imp2*a* and Imp2*b* occupy relatively stable time positions. Indeed, a slight deviation to the left or to the right of one of these pulses, due to an external disturbance, will have the effect of returning a subsequent pulse to the initial relative time position. Then, if the time drift of the mechanical oscillator varies during the synchronous phase, the oscillation will automatically sustain a slight phase shift such that the ratio between the first part and the second part of the pulses Imp1*a*, respectively Imp1*b*, Imp2*a* and Imp2*b* varies to a degree which adapts the correction induced by the braking pulses to the new difference in frequency. Such behaviour of the timepiece according to the present invention is truly remarkable.

Figure 14:
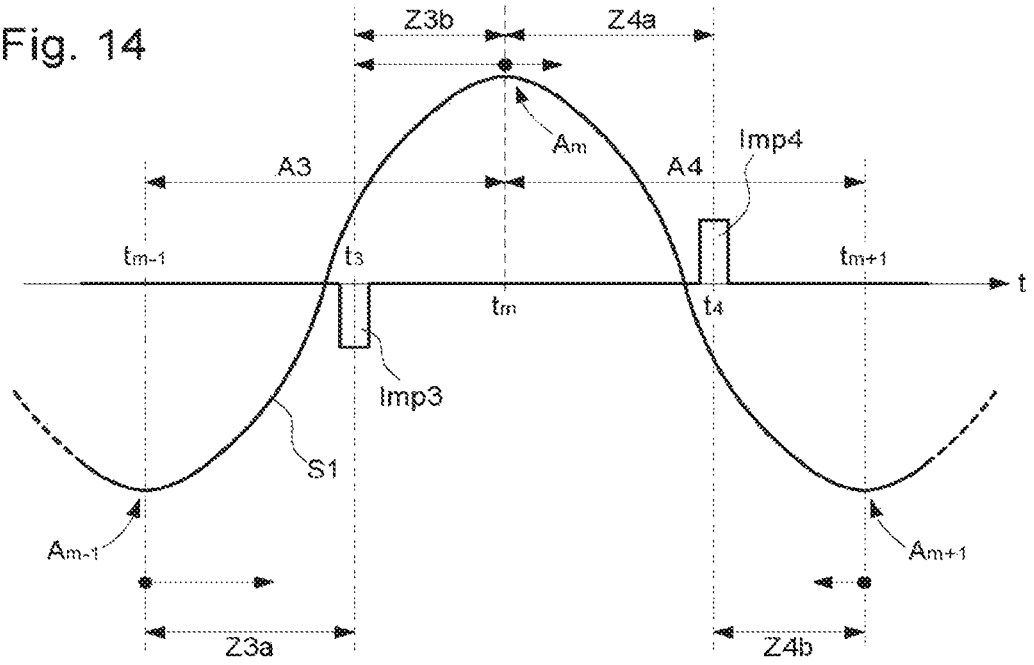
FIG. 14 is an explanatory graph of the physical process arising following the engagement of the correction device in the timepiece according to the invention and resulting in the synchronisation sought for the scenario where the natural frequency of the slave mechanical oscillator is less than the set-point frequency.
Figure 15:
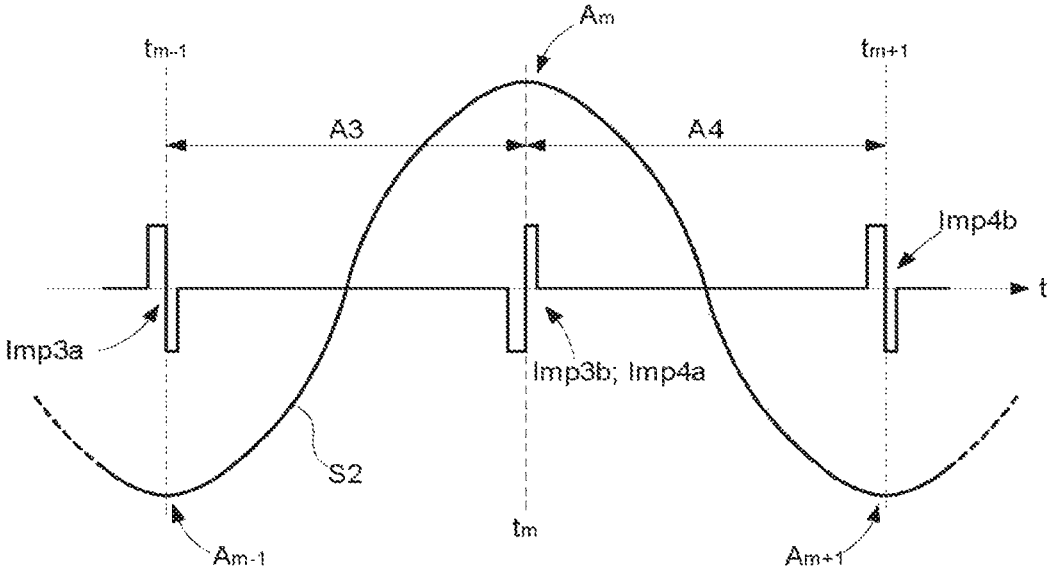
FIG. 15 represents, in the scenario of FIG. 14, an oscillation of the slave mechanical oscillator and the braking pulses in a stable synchronous phase for an alternative embodiment where a braking pulse occurs in each alternation, FIGS. 16 and 17 provide, respectively for the two scenarios of FIGS. 12 and 14, the graph of the angular position of a mechanical oscillator and the corresponding oscillation periods for an operating mode of the correction device where a braking pulse occurs every four oscillation periods.

FIGS. 14 and 15 are similar to FIGS. 12 and 13, but for a scenario where the natural frequency of the oscillator is less than the set-point frequency. Consequently, the pulses Imp3 and Imp4, corresponding to an unstable equilibrium scenario in the correction made by the braking pulses, are respectively situated in the second and the fourth quarter-period (times $t_3$ and $t_4$) where the pulses induce an increase in the oscillation frequency. The explanations will not be given in detail again here as the behaviour of the system stems from the preceding considerations. In the transitory phase (FIG. 14), if a pulse takes place in the alternation A3 to the left of the pulse Imp3 in the zone Z3*a*, the preceding end position ($t_{m-1}$, $A_{m-1}$) will progressively approach the subsequent pulses. On the other hand, if a pulse takes place to the right of the pulse Imp3 in the zone Z3*b*, the subsequent end position ($t_m$, $A_m$) will progressively approach the subsequent pulses. Similarly, if a pulse takes place in the alternation A4 to the left of the pulse Imp4 in the zone Z4*a*, the preceding end position ($t_m$, $A_m$) will progressively approach the subsequent pulses. Finally, if a pulse takes place to the right of the pulse Imp4 in the zone Z4*b*, the subsequent end position ($t_{m+1}$, $A_{m+1}$) will progressively approach the subsequent pulses during the transition phase.

In the synchronous phase (FIG. 15), if a first pulse occurs in the first alternation A3, either the end position $A_{m-1}$ of the oscillation is aligned with the pulses Imp3*a*, or the end position $A_m$ of the oscillation is aligned with the pulses Imp3*b*. In the case of a substantially constant couple, the pulses Imp3*a* and Imp3*b* each have a first part, the duration whereof is longer than that of the second part thereof, so as to correct exactly the difference between the natural frequency that is too low of the slave main oscillator and the set-point frequency set by the master auxiliary oscillator. Similarly, in the synchronous phase, if a first pulse occurs in the second alternation A4, either the end position $A_m$ of the oscillation is aligned with the pulses Imp4*a*, or the end position $A_{m+1}$ of the oscillation is aligned with the pulses Imp4*b*. The other considerations made within the scope of the scenario described above with reference to FIGS. 12 and 13 are applied by analogy to the scenario of FIGS. 14 and 15. In conclusion, whether the natural frequency of the free mechanical oscillator is too high or too low and regardless of the time of application of a first braking pulse within an oscillation period, the correction device according to the invention is effective and rapidly synchronises the frequency of the mechanical oscillator, pacing the running of the mechanical movement, on the set-point frequency which is determined by the reference frequency of the master auxiliary oscillator, which controls the braking frequency at which the braking pulses are applied to the resonator of the mechanical oscillator. This remains true if the natural frequency of the mechanical oscillator varies and even if it is, in certain time periods, greater than the set-point frequency, while in other time periods it is less than this set-point frequency.

The teaching given above and the synchronisation obtained by means of the features of the timepiece according to the invention also apply to the scenario where the braking frequency for the application of the braking pulses is not equal to the set-point frequency. In the case of the application of one pulse per oscillation period, the pulses taking place at the unstable positions ($t_1$, Imp1; $t_2$, Imp2; $t_3$, Imp3; $t_4$, Imp4) correspond to corrections to compensate for the time drift during a single oscillation period. On the other hand, if the braking pulses envisaged have a sufficient effect to correct a time drift during a plurality of oscillation periods, it is then possible to apply a single pulse per time interval equal to this plurality of oscillation periods. The same behaviour as for the scenario where one pulse is generated per oscillation period will then be observed. Taking the oscillation periods where the pulses occur into consideration, there are the same transitory phases and the same synchronous phases as in the scenario described above. Furthermore, these considerations are also correct if there is a whole number of alternations between each braking pulse. In the case of an odd number of alternations, a transition is made alternatively, depending on the case, from the alternation A1 or A3 to the alternation A2 or A4 in FIGS. 12 to 15. As the effect of two pulses offset by an alternation is identical, it is understood that the synchronisation is carried out as for an even number of alternations between two successive braking pulses. In conclusion, as already stated, the behaviour of the system described with reference to FIGS. 12 to 15 is observed once the braking frequency $F_{FR}$ is equal to $2F0_c/N$, $F0_c$ being the set-point frequency for the oscillation frequency and N a positive whole number.

Though of little interest, it should be noted that the synchronisation is also obtained for a braking frequency $F_{FR}$ greater than double the set-point frequency (2F0), namely for a value equal to N times F0 where N>2. In an alternative embodiment where $F_{FR}$=4F0, there is merely a loss of energy in the system with no effect in the synchronous phase, as one out of every two pulses occurs at the neutral point of the mechanical resonator. For a braking frequency $F_{FR}$ higher than 2F0, the pulses in the synchronous phase which do not occur at the end positions cancel the effects thereof pairwise. It is therefore understood that these are theoretical scenarios with no major practical sense.

Figure 16:
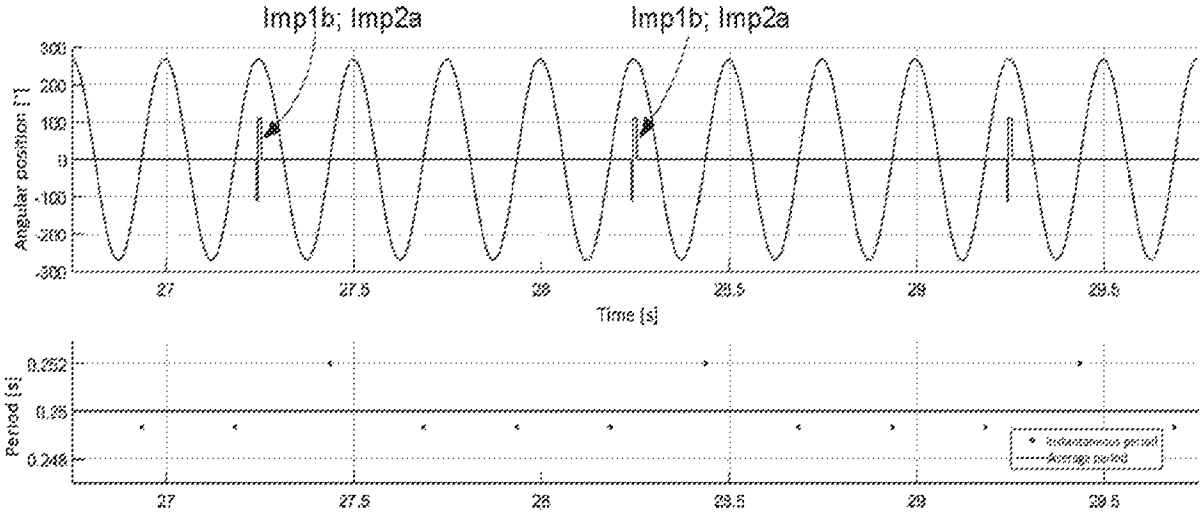
Figure 17:
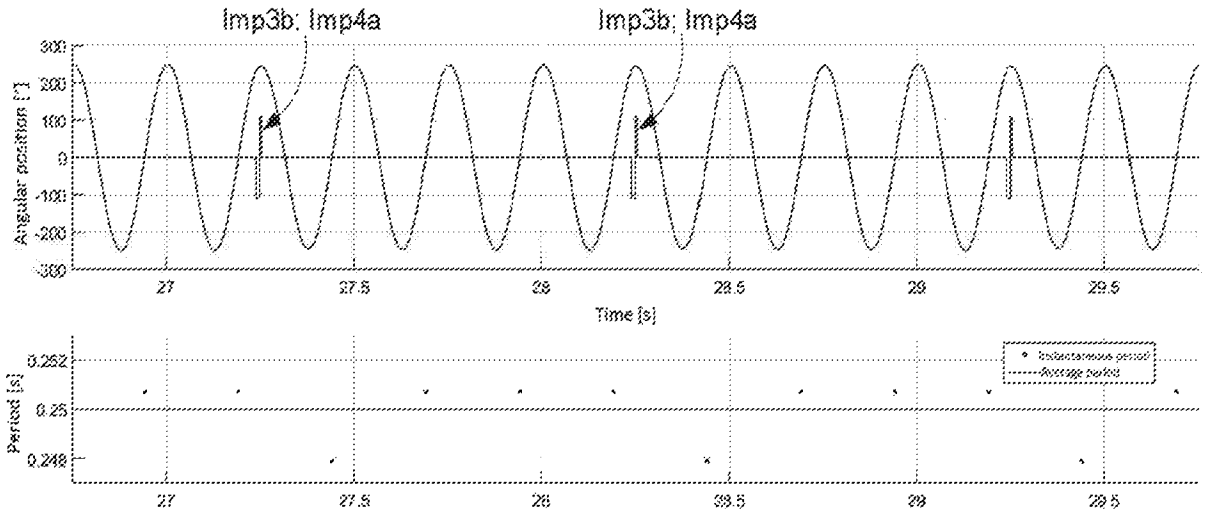
Figure 18:
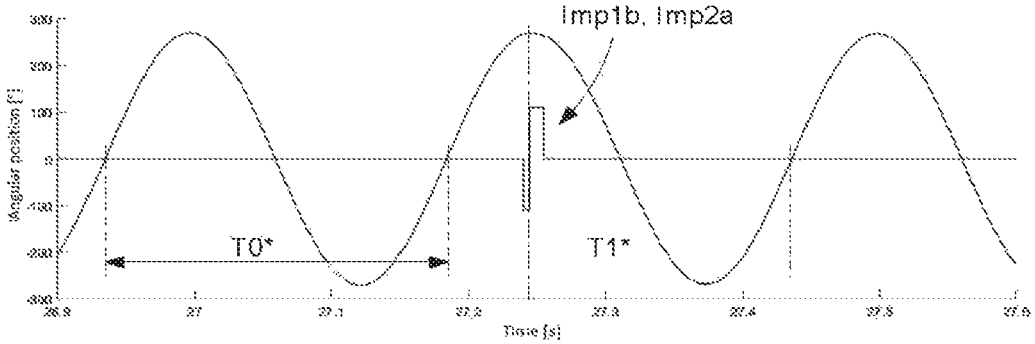
FIGS. 18 and 19 are respectively partial enlargements of FIGS. 16 and 17.
Figure 19:
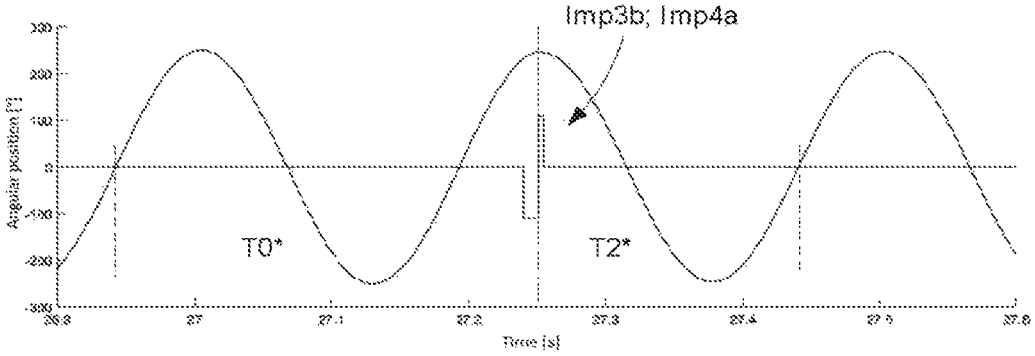
Figure 20:
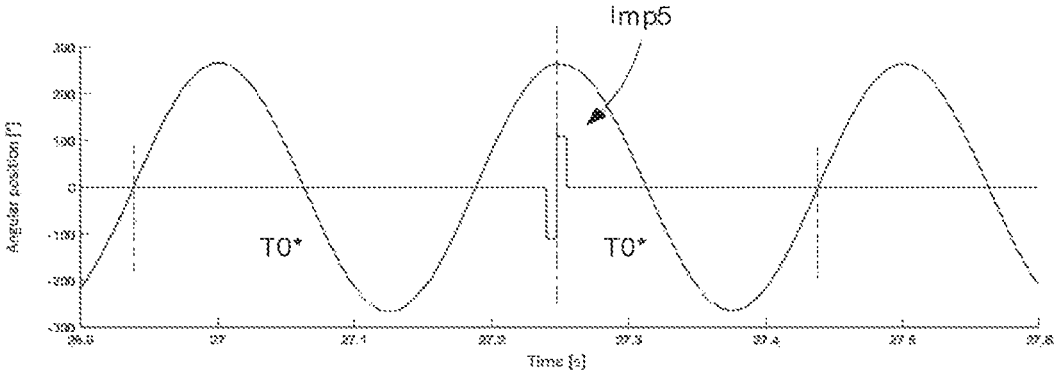
FIG. 20 represents, similarly to the two preceding figures, a specific scenario wherein the frequency of a mechanical oscillator is equal to the braking frequency.

FIGS. 16 and 17 show the synchronous phase for an alternative embodiment with a braking frequency $F_{FR}$ equal to one quarter of the set-point frequency, one braking pulse occurring therefore every four oscillation periods. FIGS. 18 and 19 are partial enlargements respectively of FIGS. 16 and 17. FIG. 16 relates to a scenario where the natural frequency of the main oscillator is greater than the set-point frequency $F0_c$=4 Hz, while FIG. 17 relates to a scenario where the natural frequency of the main oscillator is greater than this set-point frequency. It is observed that only the oscillation periods T1* and T2*, wherein braking pulses Imp1*b* or Imp2*a*, respectively Imp3*b* or Imp4*a* occur, exhibit a variation relative to the natural period T0*. The braking pulses induce a phase shift merely in the corresponding periods. Thus, the instantaneous periods oscillate in this case about an average value which is equal to that of the set-point period. It should be noted that, in FIGS. 16 to 19, the instantaneous periods are measured from a passage via zero on a rising edge of the oscillation signal to such a subsequent passage. Thus, the synchronous pulses which occur at the end positions are entirely included in oscillation periods. In order to be comprehensive, FIG. 20 shows the specific scenario where the natural frequency is equal to the set-point frequency. In this case, the oscillation periods T0* all remain equal, the braking pulses Imp5 occurring exactly at end positions of the free oscillation with first and second parts of these pulses which have identical durations (case of a constant braking torque), such that the effect of the first part is cancelled by the opposite effect of the second part.

Figure 21:
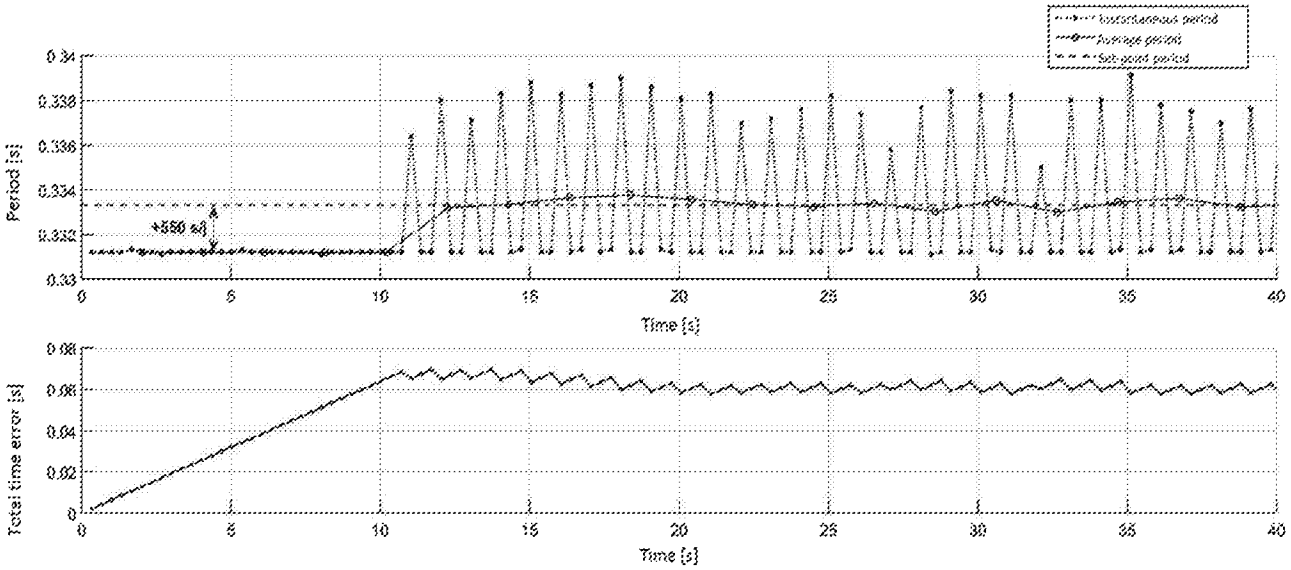
FIG. 21 shows, for an alternative embodiment of a timepiece according to the invention, the progression of the oscillation period of the slave mechanical oscillator as well as the progression of the total time error.

FIG. 21 shows the variation of the oscillation periods for a set-point frequency $F0_c$=3 Hz and a suitable braking pulse occurring every three oscillation periods of the mechanical oscillator which paces the running of a time indicator mechanism exhibiting a daily error of 550 seconds per day, i.e. about 9 minutes per day. This error is very significant, but the braking device is configured to be able to correct such an error. The braking effect having to be relatively significant in this case, there is a great variation of the instantaneous period but the average period is substantially equal to the set-point period after the engagement of the correction device in the timepiece according to the invention and a short transitory phase. When the correction device is inactive, it is observed, as expected, that the total time error increases linearly as a function of time whereas this error is rapidly stabilised after the engagement of the correction device. Thus, if the time is set after such an engagement of the correction device and the transitory phase, the total error (also referred to as 'cumulative error') remains low, such that the timepiece subsequently indicates a time with a precision corresponding to that of the master oscillator incorporated into this timepiece and associated with the braking device.

Figure 22:
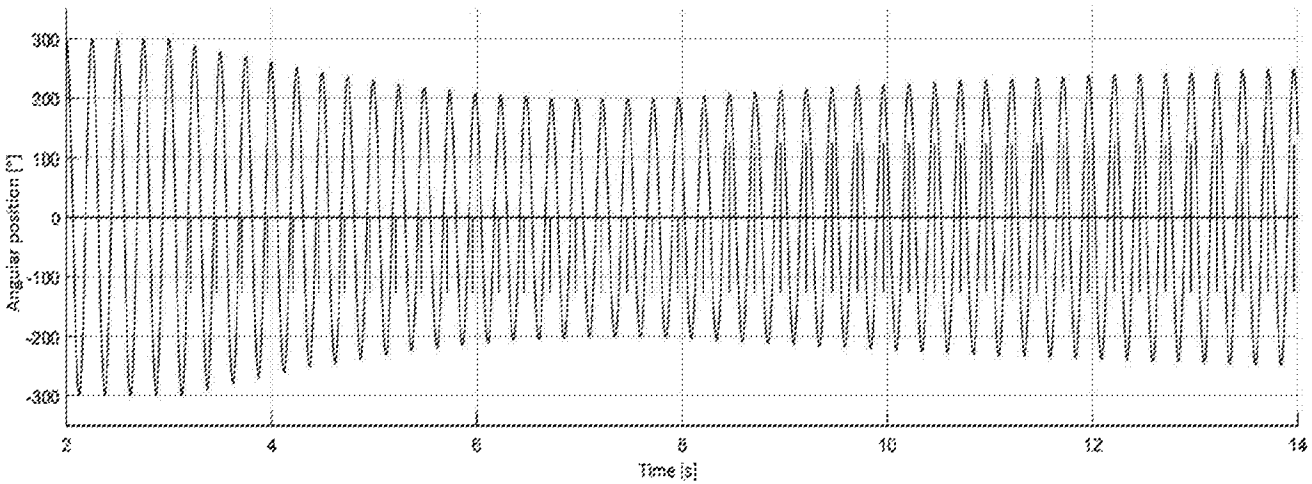
FIG. 22 shows, for a further alternative embodiment of a timepiece according to the invention, the graph of the oscillation of the slave mechanical oscillator in an initial phase following the engagement of the device for correcting a possible time drift, FIGS. 23A to 23C partially show a fourth embodiment of a timepiece according to the invention and a sequence of the operation thereof, and FIGS. 24A to 24C partially show a fifth embodiment of a timepiece according to the invention and a sequence of the operation thereof.

FIG. 22 shows the progression of the amplitude of the slave mechanical oscillator after the engagement of the correction device according to the invention. In the transitory phase, a relatively pronounced decrease in the amplitude is observed in a scenario where the first pulse takes place close to the zero position (neutral position). The various braking pulses occurring in particular in a first part of this transitory phase induce relatively significant energy losses, as seen in the graph in FIG. 8C. Subsequently, the energy losses decrease relatively rapidly to finally become minimal for a given correction in the synchronous phase. As such, it is observed that the amplitude increases again once the pulses include the passage via an end position of the mechanical resonator and continues to increase at the start of the synchronous phase although the dissipated braking energy then stabilises at the minimum thereof, given a relatively great time constant for the amplitude variation of the mechanical oscillator. Thus, the timepiece according to the invention further has the advantage of stabilising in a synchronous phase for which the energy dissipated by the oscillator, due to the braking pulses envisaged, is minimal. Indeed, the oscillator exhibits after stabilisation of the amplitude thereof the smallest possible decrease in amplitude for the braking pulses envisaged. This is an advantage as when the mainspring maintaining the main oscillator is released, the minimal oscillation amplitude to carry out the operation of the mechanical movement is achieved as late as possible while ensuring precise running. The device for correcting the running of a mechanical movement, which generates the synchronisation according to the invention therefore, has a minimised influence for the power reserve.

To minimise the disturbances generated by the braking pulses and particularly the energy losses for the timepiece movement, short pulse durations, or even very short pulse durations, will preferably be selected. Thus, in a particular alternative embodiment, each of the braking pulses has a duration of less than 1/10 of the set-point period. In a preferred alternative embodiment, the braking pulses each have a duration between 1/250 and 1/40 of said set-point period. In the latter case, for a set-point frequency equal to 4 Hz, the duration of the pulses is between 1 ms and 5 ms.

With reference to FIGS. 1 to 3, timepieces are described with mechanical resonators having a circular braking surface enabling the braking device to apply a mechanical braking pulse to the slave mechanical resonator substantially at any time of an oscillation period within the usable operating range of the slave oscillator. This is a preferred alternative embodiment. As timepiece movements generally have balances having a circular felloe with an advantageously continuous outer surface, the preferred alternative embodiment described above may be readily implemented in such movements without requiring modifications of the mechanical oscillator thereof. It is understood that this preferred alternative embodiment makes it possible to minimise the duration of the transition phase and carry out the desired synchronisation within the optimum time.

However, stable synchronisation may already be obtained, after a certain period of time, with a mechanical system, formed by the slave mechanical resonator and the mechanical braking device, which is configured so as to enable the mechanical braking device to be able to start the periodic braking pulses at any position of the slave mechanical resonator solely in a continuous or quasi-continuous range of positions of this defined resonator, on a first of the two sides from the neutral position of the slave mechanical resonator, by the range of amplitudes of the slave oscillator for the usable operating range thereof. Advantageously, this range of positions is increased, on the side of minimal amplitude, at least by an angular distance corresponding to the duration of a braking pulse, so as to enable for a minimal amplitude a braking pulse by dynamic dry friction. So that the mechanical system can act in all the alternations and not merely in all the oscillation periods, it is then necessary for this mechanical system to be configured so as to enable the mechanical braking device to also be able to start the periodic braking pulses at any position of the mechanical resonator on the second of the two sides from said neutral position, within the range of amplitudes of the slave mechanical oscillator for the usable operating range thereof. Advantageously, the range of positions is also increased, on the side of minimal amplitude, at least by an angular distance corresponding substantially to the duration of a braking pulse.

Thus, in a first general alternative embodiment, the continuous or quasi-continuous range mentioned above of positions of the slave mechanical resonator extends, on a first of the two sides from the neutral position thereof, at least over the range of amplitudes that the slave oscillator is liable to have on this first side for a usable operating range of this slave oscillator and moreover advantageously, on the side of minimal amplitude of the range of amplitudes, at least over an angular distance corresponding substantially to the duration of the braking pulses. In a second general alternative embodiment, in addition to the continuous or quasi-continuous range defined hereinabove in the first general alternative embodiment, which is a first continuous or quasi-continuous range, the mechanical system mentioned above is configured so as to enable the mechanical braking device to also be able to start the periodic braking pulses at any position of the slave mechanical resonator, on the second of the two sides from the neutral position thereof, at least in a second continuous or quasi-continuous range of positions of this slave mechanical resonator extending over the range of amplitudes that the slave oscillator is liable to have on this second side for said usable operating range and moreover advantageously, on the side of minimal amplitude of the latter range of amplitudes, at least over said first angular distance.

Finally, within the scope of the present invention, two periodic braking pulse categories may be distinguished relative to the intensity of the mechanical force couple applied to the slave mechanical resonator and the duration of the periodic braking pulses. As regards the first category, the braking torque and the duration of the braking pulses are envisaged, for the usable operating range of the slave oscillator, so as not to momentarily lock the slave mechanical resonator during the periodic braking pulses at least in the majority of the transitory phase described above. In this case, the system is arranged such that the mechanical braking torque can be applied to the slave mechanical resonator, at least in said majority of a possible transitory phase, during each braking pulse.

In an advantageous alternative embodiment, the oscillating member and the braking member are arranged such that the periodic braking pulses can be applied, at least in said majority of a possible transitory phase, essentially by dynamic dry friction between the braking member and a braking surface of the oscillating member. As regards the second category, for the usable operating range of the slave oscillator and in the synchronous phase described above, the mechanical braking torque and the duration of the periodic braking pulses are envisaged so as to lock the mechanical resonator during the periodic braking pulses at least in the end part thereof.

In a particular alternative embodiment, in the synchronous phase, a momentary locking of the slave mechanical resonator by the periodic braking pulses is envisaged while, in an initial part of a possible transitory phase where the periodic braking pulses occur outside the end positions of the slave mechanical resonator, the latter is not locked by these periodic braking pulses.

Figure 23A:
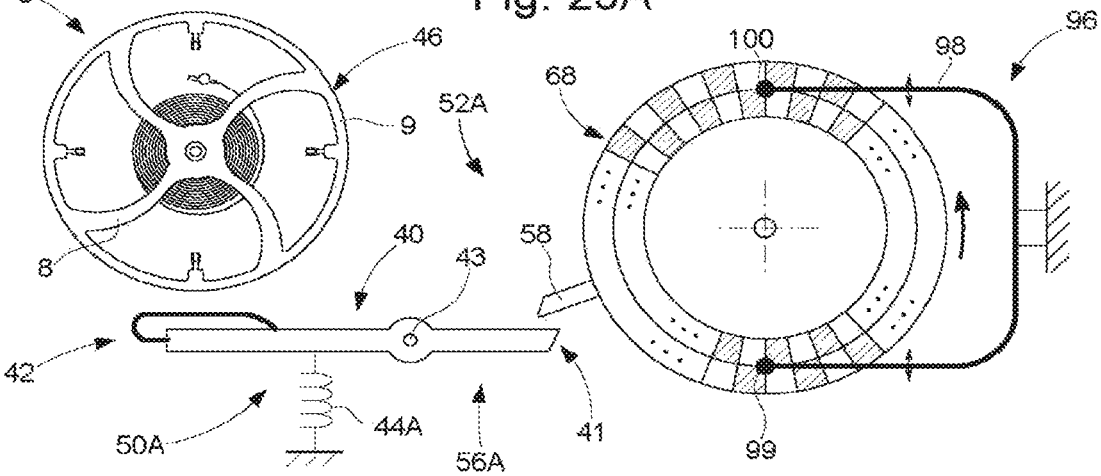
Figure 23B:
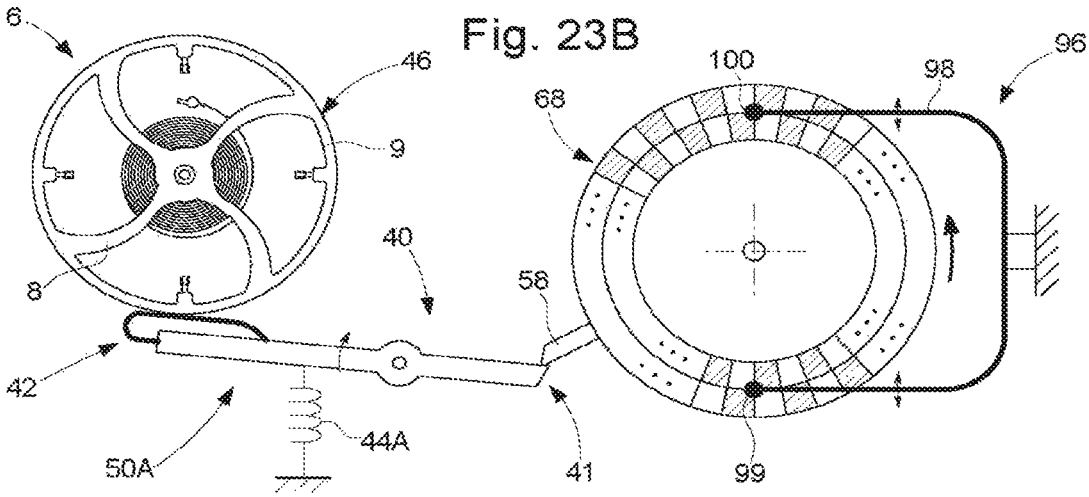
Figure 23C:
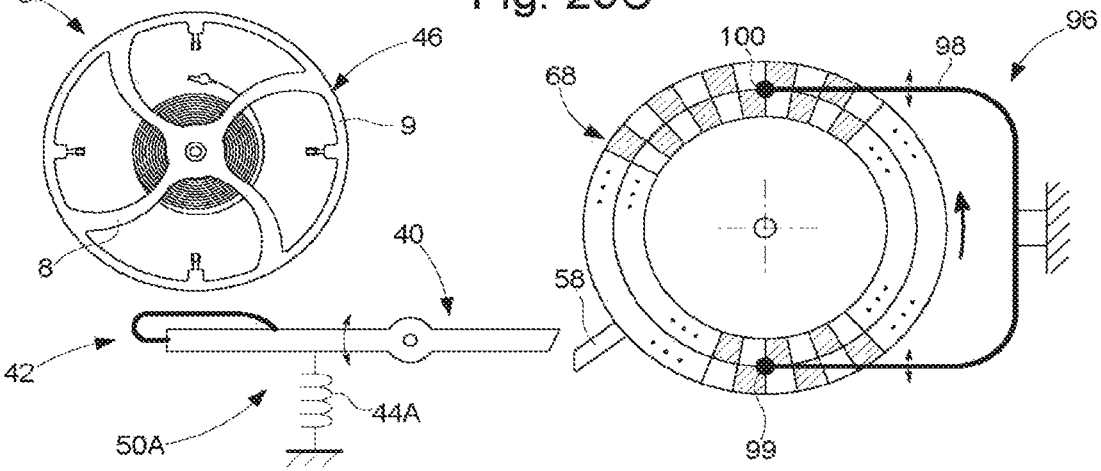

FIGS. 23A to 23C show a sequence of the operation of a correction device in a fourth embodiment of a timepiece according to the invention. Only the slave main resonator 6 and the mechanical correction device 52A have been shown. The correction device is formed by a master auxiliary oscillator 96 and by a braking device 56A, similar to that presented within the scope of the first embodiment, which comprises a braking pulse generator mechanism 50A. The master oscillator 96 resembles the oscillator 54 of the second embodiment. The operation thereof is analogous and will not be described again here. It differs as a result of the resonator 98 thereof, formed by a tuning fork which bears, at the free ends of the two vibrating branches thereof, respectively two magnets 99 and 100 which have an axial magnetisation. These magnets are used to couple the resonator 98 to an escapement wheel 68. The escapement wheel and the two magnets form the magnetic escapement of the master oscillator 96. Since the tuning fork has a fundamental resonance mode with the two branches thereof oscillating in opposite phase and since the two magnets 99 and 100 that it bears are arranged when idle in a diametrically opposed manner relative to the rotational axis of the escapement wheel, the number of magnetic periods of the magnetic structure of the escapement wheel is envisaged to be even. The tuning fork can have a relatively high natural frequency such that, in an alternative embodiment, the actuating finger 58 is considered such that it is arranged on a wheel set of a gear train for the auxiliary transmission of the mechanical power required for the operation of the correction device 52A, this wheel set rotating at a slower speed than the escapement wheel 68.

The operation of the correction device differs from that of the previous embodiments in that the control mechanism formed by the escapement wheel 68 and the actuating finger 58 acts in reverse on the braking pulse generator mechanism 50A. As in FIG. 2A, when the finger 58 rotates towards the end 41 of the lever 40, the latter is idle and the strip spring 42 is at a certain distance from the braking surface 46 of the balance 8 (FIG. 23A). However, as soon as the finger comes into contact with the end 41 of the lever, the latter begins to rotate in the clockwise direction and the strip spring gradually rotates towards the braking surface 46 until touching same, whereas the finger 58 is still bearing against said end 41 (FIG. 23B showing the lever when coming into contact with the balance). Then, since the finger continues its continuous advance, the strip spring increasingly presses against the balance to brake same until the contact between the finger and said end is lost and the lever is thus released (FIG. 23C), which ends the braking pulse since the lever is thus pulled backwards by the spring 44A which was expanded in the previous phase.

The force of the spring 44A can be very low in this case, however sufficient damping is preferably envisaged in order to prevent an oscillation of the lever, after the release thereof, causing a second parasitic braking pulse during the braking period following the first pulse. The duration of the braking pulses is determined by the angular distance over which the actuating finger remains in contact with the end of the lever after the time at which the strip spring touches the braking surface. This angular distance can be set to a given value, in particular by adjusting the length of the actuating finger. It should be noted that the braking torque increases in this case during the braking pulse, then decreases almost instantaneously as soon as the lever is released. This force couple can be set to a given value, in particular as a function of the rigidity of the strip spring and the length ratio between the two arms of the lever.

Figure 24A:
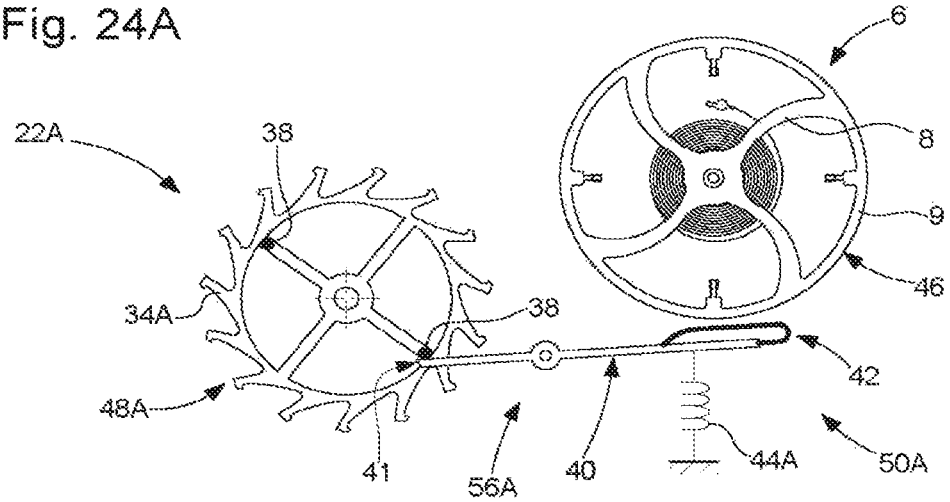
Figure 24B:
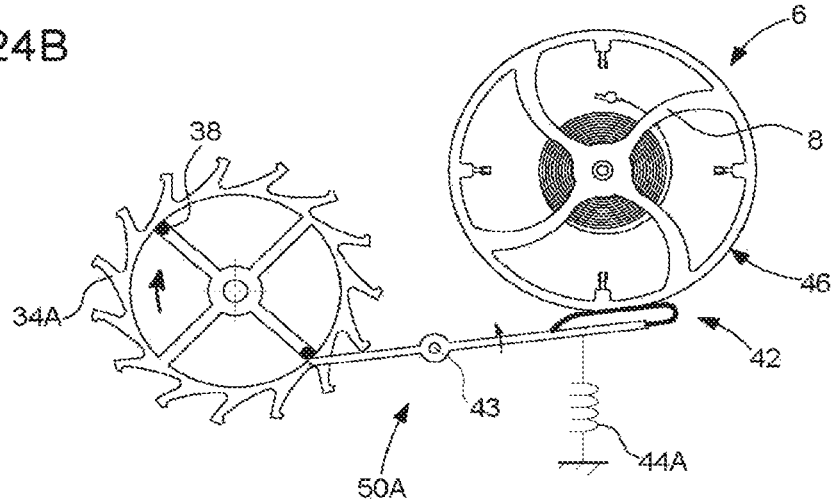
Figure 24C:
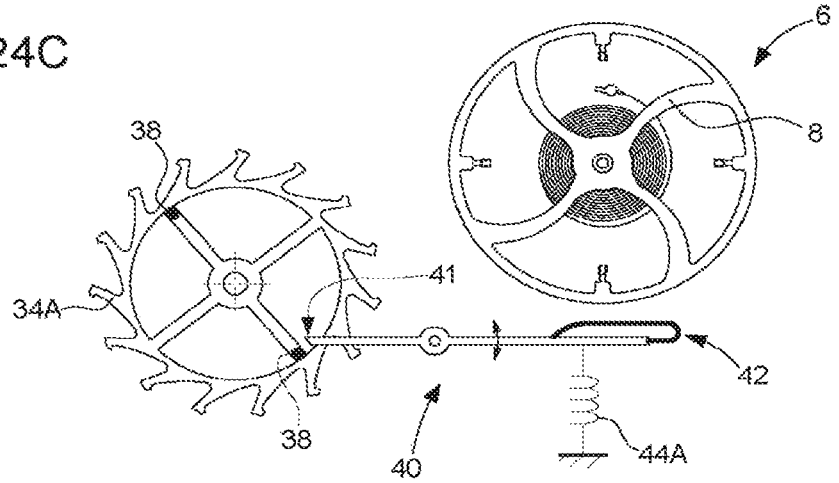

FIGS. 24A to 24C show a sequence of the operation of a correction device in a fifth embodiment of a timepiece according to the invention. Only the slave main resonator 6 and a part of the mechanical correction device have been shown. The correction device is formed by a master auxiliary oscillator 22A, only the escapement wheel 34A whereof has been shown (the resonator thereof and the pallet assembly being similar to those shown in FIG. 1), and by a braking device 56A. Thus, similarly to the first embodiment, the escapement wheel rotates in steps with an angular velocity determined by the reference frequency of the master resonator. The braking device comprises a braking pulse generator mechanism 50A similar to that presented hereinabove within the scope of the fourth embodiment. This pulse generator operates in the same manner to that of the fourth embodiment. The control mechanism 48A of the braking device is, in this case, formed by the escapement wheel and by two pins 38 attached to this wheel in a diametrically opposed manner.

As opposed to the previous embodiment, the control mechanism advances in steps. The generation of a braking pulse is envisaged during a step of the escapement wheel (FIG. 24B). This wheel has, for example, 15 teeth and the master oscillator 22A operates at a reference frequency of 7.5 Hz. The escapement wheel performs a ½ revolution per second such that the braking pulses are produced at a braking frequency of 1 Hz. At each period of the master oscillator, the wheel 34A performs two steps and advances by an angular distance equal to 24°, such that at least one of the two steps corresponds to a rotation of at least 12°. The end 41 of the lever 40 is configured and positioned relative to the circle defined by the rotating pins 38 so as to allow the braking pulse to be entirely produced during a given step of the control wheel. It should be noted that the lever has advantageously already been rotated during a step of the control wheel preceding the step occurring in order to induce a braking pulse. In such a case, care is taken to arrange the braking device such that the strip spring 42 rotates towards the braking surface 46 of the balance during said preceding step without touching this braking surface, but by stopping a short distance therefrom (FIG. 24A).

FIGS. 24A to 24C show three configurations of the braking device occurring over a reference period during which the escapement wheel performs two successive steps. FIG. 24A shows a first state of the braking device at the end of a determined step of the wheel 34A. FIG. 24B shows a second state of the braking device during a first step directly following said determined step (application of a braking pulse to the balance 8). FIG. 24C corresponds to a third state wherein the wheel 34A has completed the first step represented in FIG. 24B, before a second step occurs directly following said first step. Given that during a step, the wheel 34A rotates very quickly (free rotation), the duration of the braking pulses can thus be relatively short.

The invention claimed is:

1. A timepiece comprising a mechanical movement comprising:

an indicator mechanism of at least one time data item, a mechanical resonator suitable for oscillating along a general oscillation axis about a neutral position corresponding to a minimum potential energy state thereof, a maintenance device of the mechanical resonator forming therewith a mechanical oscillator which is arranged to pace a running of the indicator mechanism;

the timepiece further comprising a device for regulating a medium frequency of said mechanical oscillator;

wherein said regulation device is mechanical, this mechanical regulation device being formed by a mechanical auxiliary oscillator, which defines a master oscillator, and by a mechanical braking device of said mechanical resonator; and in that the mechanical braking device is arranged to be able to apply to said mechanical resonator a dissipative mechanical braking torque during periodic braking pulses which are generated at a braking frequency selected merely as a function of a set-point frequency for said mechanical oscillator, which defines a slave oscillator, and determined by said master oscillator, the mechanical system formed by said mechanical resonator and the mechanical braking device being configured so as to enable the mechanical braking device to be able to start said periodic braking pulses at any position of said mechanical resonator in a range of positions, along said general oscillation axis, which extends at least on a first of two sides from the neutral position of said mechanical resonator over at least one range of amplitudes that said slave oscillator is liable to have on this first side for a usable operating range of this slave oscillator.

2. The timepiece according to claim 1, wherein a first part of said range of positions of the mechanical resonator, incorporating said range of the amplitudes that the mechanical oscillator is liable to have on said first side from the neutral position of said mechanical resonator, has a certain range whereon it is continuous or quasi-continuous, this first part extending, on a side of a minimal amplitude of said range of amplitudes, at least over an angular distance substantially corresponding to a duration of one of said periodic braking pulses for this minimal amplitude.

3. The timepiece according to claim 1, wherein said mechanical system is configured such that said range of positions of the mechanical resonator, wherein said periodic braking pulses may start, also extends on a second of the two sides from the neutral position of said mechanical resonator over at least one range of amplitudes that said mechanical oscillator is liable to have on this second side for said usable operating range of this mechanical oscillator.

4. The timepiece according to claim 3, wherein a second part of said range of positions of the mechanical resonator, incorporating said range of amplitudes that the mechanical oscillator is liable to have on said second side from the neutral position of said mechanical resonator, has a certain range whereon it is continuous or quasi-continuous, this second part extending, on a side of a minimal amplitude of the range of amplitudes that the mechanical oscillator is liable to have on the second side from said neutral position, at least over an angular distance substantially corresponding to the duration of one of said periodic braking pulses for this minimal amplitude.

5. The timepiece according to claim 3, wherein said braking frequency is envisaged to be equal to double said set-point frequency divided by a positive whole number N, i.e. $F_{FR}=2\cdot F0_c/N$ where $F_{FR}$ is the braking frequency and $F0_c$ is the set-point frequency.

6. The timepiece according to claim 3, wherein said mechanical braking device is arranged so as to apply to said mechanical resonator said dissipative mechanical braking torque substantially by friction and such that the periodic braking pulses each have a duration of less than one quarter of the set-point period corresponding to the reciprocal of the set-point frequency.

7. The timepiece according to claim 3, wherein the mechanical braking device is arranged so as to apply to said mechanical resonator said dissipative mechanical braking torque substantially by friction and such that the periodic braking pulses each have a duration of less than 1/10 of the set-point period corresponding to the reciprocal of the set-point frequency.

8. The timepiece according to claim 3, wherein the mechanical braking device is arranged so as to apply to said mechanical resonator said dissipative mechanical braking torque substantially by friction and such that the periodic braking pulses each have a duration of less than 1/40 of the set-point period corresponding to the reciprocal of the set-point frequency.

9. The timepiece according to claim 3, wherein said mechanical system is configured so as to enable the mechanical braking device to start, in said usable operating range of said slave oscillator, one of said periodic braking pulses at any position of said mechanical resonator along said general oscillation axis.

10. The timepiece according to claim 3, wherein said master oscillator comprises a master resonator which is formed by a balance-hairspring or a balance mounted on flexible strips.

11. The timepiece according to claim 3, wherein said master oscillator comprises an escapement provided with a stop pin and thus operating in a stepped mode.

12. The timepiece according to claim 3, wherein said master oscillator comprises a master resonator which is formed by a tuning fork.

13. The timepiece according to claim 3, wherein said master oscillator comprises a continuous rotating escapement of the magnetic type, with a magnetic coupling between a master resonator forming this master oscillator and an escapement wheel forming the continuous rotating escapement.

14. The timepiece according to claim 3, wherein said master oscillator is associated with a mechanism for equalizing the force exerted on the master resonator thereof in order to maintain the oscillation thereof.

15. The timepiece according to claim 3, wherein the mechanical braking device comprises a control mechanism and a braking pulse generator mechanism which is arranged to be actuated by the control mechanism at said braking frequency, so as to apply to an oscillating member of the mechanical resonator of said slave oscillator said dissipative mechanical braking torque during said periodic braking pulses.

16. The timepiece according to claim 15, wherein said braking pulse generator mechanism comprises a lever associated with a spring or a flexible element and provided with a braking member arranged to come into contact with a braking surface of said oscillating member during said periodic braking pulses.

17. The timepiece according to claim 16, wherein said control mechanism comprises an actuating finger or an actuating pin arranged on a control wheel so as to be able to actuate, upon each revolution of this control wheel, said lever in order to generate one of said periodic braking pulses; and in that the control wheel is driven in rotation at an average speed which is determined by said master oscillator.

18. The timepiece according to claim 17, wherein said control wheel is rigidly connected to an escapement wheel of said master oscillator.

19. The timepiece according to claim 17, wherein said control wheel is rigidly connected to a wheel set for transmitting power from a mechanical barrel to said master oscillator, this transmission wheel being kinematically connected to an escapement wheel of the master oscillator.

20. The timepiece according to claim 17, wherein said mechanical braking device is arranged such that the actuating finger or the actuating pin comes, upon each revolution of the control wheel, momentarily into contact with said lever firstly in order to rotate same and thus arm the braking pulse generator mechanism, and then in order to trigger one of said periodic braking pulses at a time when the contact between the actuating finger or the actuating pin and said generator mechanism is interrupted.

21. The timepiece according to claim 3, wherein it comprises an auxiliary barrel envisaged for powering said master oscillator and not said slave oscillator, the latter being powered by a main barrel.

22. The timepiece according to claim 3, wherein said periodic braking pulses have a force couple and a duration which are envisaged, for said usable operating range of the slave oscillator, so as not to lock momentarily said mechanical resonator during the periodic braking pulses at least in the majority of a potential transitory phase in the operation of the timepiece, this transitory phase being liable to occur, particularly following an engagement of the mechanical regulation device, before a synchronous phase where the slave oscillator is synchronized with said periodic braking pulses; and in that said mechanical system is arranged such that said dissipative mechanical braking torque can be applied to said mechanical resonator, at least in said majority of said potential transitory phase, during said duration of each of the periodic braking pulses.

23. The timepiece according to claim 3, wherein, for said usable operating range of said slave oscillator and in a synchronous phase of the operation of the timepiece where this slave oscillator is synchronized with said periodic braking pulses, these periodic braking pulses have a force couple and a duration which are envisaged so as to momentarily lock said mechanical resonator during periodic braking pulses at least in the end part thereof.

* * * * *